US012402654B2

(12) United States Patent
Casselman et al.

(10) Patent No.: US 12,402,654 B2
(45) Date of Patent: Sep. 2, 2025

(54) VAPORIZER DEVICE AND CARTRIDGE

(71) Applicant: JUUL Labs, Inc., San Francisco, CA (US)

(72) Inventors: Ashley V. Casselman, San Francisco, CA (US); Ian Garcia-Doty, Oakland, CA (US); Eddie G. Gonzalez, San Francisco, CA (US); Alexander M. Hoopai, San Francisco, CA (US); Esteban Leon Duque, Berkeley, CA (US); Nihir B. Shah, San Francisco, CA (US); Paul R. Vieira, Oakland, CA (US)

(73) Assignee: JUUL Labs, Inc., Washington, DC (US)

( * ) Notice: Subject to any disclaimer, the term of this patent is extended or adjusted under 35 U.S.C. 154(b) by 600 days.

(21) Appl. No.: 17/382,186

(22) Filed: Jul. 21, 2021

(65) Prior Publication Data

US 2021/0345668 A1 Nov. 11, 2021

Related U.S. Application Data

(63) Continuation of application No. PCT/US2020/015091, filed on Jan. 24, 2020.
(Continued)

(51) Int. Cl.
*A24F 40/42* (2020.01)
*A24F 40/44* (2020.01)
(Continued)

(52) U.S. Cl.
CPC ..... *A24F 40/42* (2020.01); *A24F 40/44* (2020.01); *A24F 40/46* (2020.01); *A24F 40/51* (2020.01); *A24F 40/65* (2020.01); *A24F 40/70* (2020.01)

(58) Field of Classification Search
CPC ..... A24F 40/42; A24F 40/46; A24F 40/44; A24F 40/65
See application file for complete search history.

(56) References Cited

U.S. PATENT DOCUMENTS 3,373,915 A 3/1968 Anderson et al.
3,559,655 A 2/1971 Briskin
(Continued)

FOREIGN PATENT DOCUMENTS

CA 3010559 A1 7/2017
CN 102753047 A 10/2012
(Continued)

OTHER PUBLICATIONS

Guo, et al. (Mar. 31, 2016) "Heat Transfer Performance of Atomizer of Electronic Cigar", Popular Science and Technology, 18(3):52-54.
(Continued)

*Primary Examiner* — Michael H. Wilson
*Assistant Examiner* — Jennifer A Kessie
(74) *Attorney, Agent, or Firm* — Mintz Levin Cohn Ferris Glovsky and Popeo, P.C.

(57) ABSTRACT

A vaporizer device includes a vaporizer cartridge having a reservoir that holds a vaporizable material, a heating element, and a wicking element that can draw the vaporizable material to the heating element to be vaporized. The vaporizer cartridge is configured for coupling to a vaporizer device body and containing the vaporizable material. The wicking element of the vaporizer cartridge may include tobacco.

16 Claims, 21 Drawing Sheets

Related U.S. Application Data

(60) Provisional application No. 62/797,037, filed on Jan. 25, 2019.

(51) Int. Cl.

| | |
|---|---|
| ***A24F 40/46*** | (2020.01) |
| ***A24F 40/51*** | (2020.01) |
| ***A24F 40/65*** | (2020.01) |
| ***A24F 40/70*** | (2020.01) |

(56) References Cited

U.S. PATENT DOCUMENTS

| | | | |
|---|---|---|---|
| 3,584,631 | A | 6/1971 | Halter et al. |
| 4,708,151 | A | 11/1987 | Shelar |
| 5,042,509 | A | 8/1991 | Banerjee et al. |
| 5,065,776 | A | 11/1991 | Lawson et al. |
| 5,203,355 | A | 4/1993 | Clearman et al. |
| 5,249,586 | A | 10/1993 | Morgan et al. |
| 5,479,948 | A | 1/1996 | Counts et al. |
| 6,450,419 | B1 | 9/2002 | Martens et al. |
| 7,726,320 | B2 | 6/2010 | Robinson et al. |
| 8,490,629 | B1 | 7/2013 | Shenassa et al. |
| 8,671,952 | B2 | 3/2014 | Winterson et al. |
| 8,794,231 | B2 | 8/2014 | Thorens et al. |
| 8,833,364 | B2 | 9/2014 | Buchberger |
| 8,869,792 | B1 | 10/2014 | Lee |
| 8,991,402 | B2 | 3/2015 | Bowen et al. |
| 9,408,416 | B2 | 8/2016 | Monsees et al. |
| 9,420,829 | B2 | 8/2016 | Thorens et al. |
| 9,603,389 | B2 | 3/2017 | Chen |
| 9,844,234 | B2 | 12/2017 | Thorens et al. |
| 9,943,107 | B2 | 4/2018 | Weigensberg et al. |
| 9,943,114 | B2 | 4/2018 | Batista |
| 10,045,561 | B2 | 8/2018 | Flick |
| 10,299,514 | B2 | 5/2019 | Bilat et al. |
| 10,398,175 | B2 | 9/2019 | Thorens |
| 10,412,996 | B2 | 9/2019 | Bright et al. |
| 10,440,997 | B2 | 10/2019 | Borkovec et al. |
| 10,512,285 | B2 | 12/2019 | Kuczaj |
| 10,518,243 | B2 | 12/2019 | Macko et al. |
| 10,721,969 | B2 | 7/2020 | Capuano et al. |
| 10,729,177 | B2 | 8/2020 | Dendy et al. |
| 10,729,179 | B2 | 8/2020 | Atkins et al. |
| 10,772,356 | B2 | 9/2020 | Tucker et al. |
| 10,869,501 | B2 | 12/2020 | Thorens et al. |
| 10,897,930 | B2 | 1/2021 | Weigensberg et al. |
| 10,905,835 | B2 | 2/2021 | Atkins et al. |
| 10,925,315 | B2 | 2/2021 | Bilat |
| 10,994,086 | B2 | 5/2021 | Garthaffner et al. |
| 11,006,669 | B2 | 5/2021 | Reevell |
| 11,013,267 | B2 | 5/2021 | Rostami et al. |
| 11,051,549 | B2 | 7/2021 | Borkovec |
| 11,129,414 | B2 | 9/2021 | Atkins et al. |
| 11,147,128 | B2 | 10/2021 | Qiu |
| 11,197,497 | B2 | 12/2021 | Lee et al. |
| 11,241,044 | B2 | 2/2022 | Atkins et al. |
| 11,290,182 | B2 | 3/2022 | Bache et al. |
| 11,297,877 | B2 | 4/2022 | Zinovik et al. |
| 11,464,082 | B2 | 10/2022 | Jobanputra et al. |
| 11,700,874 | B2 | 7/2023 | Alizon et al. |
| 12,010,782 | B2 | 6/2024 | Horrod et al. |
| 12,156,538 | B2 | 12/2024 | Leah et al. |
| 2004/0055613 | A1 | 3/2004 | Horian |
| 2005/0268911 | A1 | 12/2005 | Cross et al. |
| 2006/0032501 | A1 | 2/2006 | Hale et al. |
| 2007/0283972 | A1 | 12/2007 | Monsees et al. |
| 2008/0092912 | A1 | 4/2008 | Robinson et al. |
| 2009/0126746 | A1 | 5/2009 | Strickland et al. |
| 2009/0151717 | A1 | 6/2009 | Bowen et al. |
| 2009/0260642 | A1 | 10/2009 | Monsees et al. |
| 2010/0024834 | A1 | 2/2010 | Oglesby et al. |
| 2011/0041861 | A1 | 2/2011 | Sebastian et al. |
| 2011/0226236 | A1 | 9/2011 | Buchberger |
| 2011/0290267 | A1 | 12/2011 | Yamada et al. |
| 2013/0042865 | A1 | 2/2013 | Monsees et al. |
| 2013/0284192 | A1 | 10/2013 | Peleget et al. |
| 2013/0319439 | A1 | 12/2013 | Gorelick et al. |
| 2013/0340775 | A1 | 12/2013 | Juster et al. |
| 2014/0301721 | A1 | 10/2014 | Ruscio et al. |
| 2014/0366898 | A1 | 12/2014 | Monsees et al. |
| 2015/0027439 | A1 | 1/2015 | Hutchens et al. |
| 2015/0053220 | A1 | 2/2015 | Levy et al. |
| 2015/0136158 | A1 | 5/2015 | Stevens et al. |
| 2015/0272218 | A1 | 10/2015 | Chen |
| 2015/0296889 | A1 | 10/2015 | Liu |
| 2015/0320116 | A1 | 11/2015 | Bleloch et al. |
| 2015/0335070 | A1 | 11/2015 | Sears et al. |
| 2016/0015082 | A1 | 1/2016 | Liu |
| 2016/0120222 | A1 | 5/2016 | Bagai et al. |
| 2016/0120225 | A1 | 5/2016 | Mishra et al. |
| 2016/0120227 | A1* | 5/2016 | Levitz ..... F16K 31/60 141/2 |
| 2016/0128387 | A1 | 5/2016 | Chen |
| 2016/0150828 | A1 | 6/2016 | Goldstein et al. |
| 2016/0295922 | A1 | 10/2016 | John et al. |
| 2016/0309782 | A1 | 10/2016 | Malgat et al. |
| 2016/0338412 | A1 | 11/2016 | Monsees et al. |
| 2017/0035116 | A1 | 2/2017 | Batista |
| 2017/0055575 | A1 | 3/2017 | Wilke et al. |
| 2017/0055580 | A1 | 3/2017 | Blandino et al. |
| 2017/0071250 | A1 | 3/2017 | Mironov et al. |
| 2017/0119055 | A1 | 5/2017 | Liu |
| 2017/0143041 | A1 | 5/2017 | Batista et al. |
| 2017/0156403 | A1 | 6/2017 | Gill et al. |
| 2017/0164657 | A1 | 6/2017 | Batista |
| 2017/0224021 | A1 | 8/2017 | Xiang |
| 2017/0280769 | A1 | 10/2017 | Li et al. |
| 2018/0027877 | A1* | 2/2018 | Tucker ..... H05B 3/42 |
| 2018/0027883 | A1 | 2/2018 | Zuber et al. |
| 2018/0084823 | A1 | 3/2018 | Fuisz et al. |
| 2018/0110263 | A1 | 4/2018 | Borkovec et al. |
| 2018/0132534 | A1 | 5/2018 | Reevell |
| 2018/0228216 | A1 | 8/2018 | Saygili |
| 2018/0271140 | A1 | 9/2018 | Kobal et al. |
| 2018/0279685 | A1 | 10/2018 | Thorens et al. |
| 2018/0295881 | A1 | 10/2018 | Mironov et al. |
| 2018/0325179 | A1 | 11/2018 | Li et al. |
| 2019/0001077 | A1* | 1/2019 | Xu ..... A61M 11/044 |
| 2019/0037921 | A1 | 2/2019 | Kennedy et al. |
| 2019/0098930 | A1 | 4/2019 | Fallon et al. |
| 2019/0104764 | A1 | 4/2019 | Tucker et al. |
| 2019/0124982 | A1 | 5/2019 | Atkins et al. |
| 2019/0166913 | A1 | 6/2019 | Trzecieski |
| 2019/0191769 | A1 | 6/2019 | Qiu |
| 2019/0200674 | A1 | 7/2019 | Tucker et al. |
| 2019/0200677 | A1 | 7/2019 | Chong et al. |
| 2019/0208827 | A1 | 7/2019 | Mironov et al. |
| 2020/0107585 | A1 | 4/2020 | Atkins et al. |
| 2020/0113245 | A1 | 4/2020 | Rosser et al. |
| 2020/0120993 | A1 | 4/2020 | Atkins et al. |
| 2020/0128874 | A1 | 4/2020 | Atkins et al. |
| 2021/0186113 | A1 | 6/2021 | Lee |
| 2021/0321672 | A1 | 10/2021 | Wilke et al. |
| 2021/0386120 | A1 | 12/2021 | Gill |
| 2022/0046997 | A1 | 2/2022 | Atkins et al. |
| 2022/0095685 | A1 | 3/2022 | Atkins et al. |
| 2022/0104550 | A1 | 4/2022 | Mao et al. |
| 2022/0151285 | A1 | 5/2022 | Garcia-Doty |
| 2022/0160040 | A1 | 5/2022 | Zhang et al. |
| 2022/0295894 | A1 | 9/2022 | Batista et al. |
| 2023/0309615 | A1 | 10/2023 | Mauchle et al. |

FOREIGN PATENT DOCUMENTS

| | | | |
|---|---|---|---|
| CN | 202873796 | U | 4/2013 |
| CN | 103783674 | A | 5/2014 |
| CN | 203748667 | U | 8/2014 |
| CN | 205337599 | U | 6/2016 |
| CN | 105764367 | A | 7/2016 |
| CN | 106307622 | A | 1/2017 |
| CN | 106572705 | A | 4/2017 |
| CN | 106659247 | A | 5/2017 |
| CN | 106659250 | A | 5/2017 |

(56) References Cited

FOREIGN PATENT DOCUMENTS

| | | | |
|---|---|---|---|
| CN | 106858726 | A | 6/2017 |
| CN | 107772540 | A | 3/2018 |
| CN | 207531900 | U | 6/2018 |
| CN | 207885656 | U | 9/2018 |
| CN | 110893019 | A | 3/2020 |
| CN | 111067144 | A | 4/2020 |
| CN | 111432670 | A | 7/2020 |
| CN | 111887498 | A | 11/2020 |
| CN | 112351697 | A | 2/2021 |
| CN | 112602080 | A | 4/2021 |
| CN | 113163855 | A | 7/2021 |
| CN | 113163857 | A | 7/2021 |
| CN | 113163875 | A | 7/2021 |
| CN | 113194769 | A | 7/2021 |
| CN | 113226073 | A | 8/2021 |
| CN | 113226078 | A | 8/2021 |
| CN | 113226080 | A | 8/2021 |
| CN | 113286528 | A | 8/2021 |
| CN | 113365518 | A | 9/2021 |
| CN | 113382647 | A | 9/2021 |
| CN | 113939203 | A | 1/2022 |
| CN | 110639103 | B | 4/2023 |
| EP | 2394520 | A1 | 12/2011 |
| EP | 3000245 | B1 | 2/2018 |
| EP | 3420829 | A1 | 1/2019 |
| EP | 3664631 | A2 | 6/2020 |
| EP | 2999367 | B1 | 10/2020 |
| EP | 3795009 | A1 | 3/2021 |
| EP | 3829366 | A1 | 6/2021 |
| EP | 3656228 | B1 | 3/2022 |
| EP | 3694353 | B1 | 11/2022 |
| GB | 2527597 | A | 12/2015 |
| GB | 2547699 | A | 8/2017 |
| GB | 2568411 | B | 8/2019 |
| JP | S5138499 | A | 3/1976 |
| JP | 2001-507576 | A | 6/2001 |
| JP | 2010506594 | A | 3/2010 |
| JP | 2010517568 | A | 5/2010 |
| JP | 2010178730 | A | 8/2010 |
| JP | 2013516159 | A | 5/2013 |
| JP | 2015-509709 | A | 4/2015 |
| JP | 2016538847 | A | 12/2016 |
| JP | 2016538850 | A | 12/2016 |
| JP | 2017018146 | A | 1/2017 |
| JP | 2017-529896 | A | 10/2017 |
| JP | 2017529848 | A | 10/2017 |
| JP | 2017533732 | A | 11/2017 |
| JP | 2020-096584 | A | 6/2020 |
| JP | 2020536536 | A | 12/2020 |
| KR | 20-2012-0008751 | U | 12/2012 |
| KR | 10-2013-0092252 | A | 8/2013 |
| KR | 10-2016-0112769 | A | 9/2016 |
| KR | 10-2021-0082181 | A | 7/2021 |
| KR | 10-2021-0155091 | A | 12/2021 |
| RU | 2602053 | C2 | 11/2016 |
| RU | 2604313 | C2 | 12/2016 |
| RU | 2629878 | C1 | 9/2017 |
| RU | 2655239 | C2 | 5/2018 |
| TW | 202042679 | A | 12/2020 |
| WO | WO-2006120570 | A2 | 11/2006 |
| WO | WO-2011079932 | A1 | 7/2011 |
| WO | WO-2013060743 | A2 | 5/2013 |
| WO | WO-2015082651 | A1 | 6/2015 |
| WO | WO-2015155289 | A1 | 10/2015 |
| WO | WO-2015179388 | A1 | 11/2015 |
| WO | WO-2016005533 | A1 | 1/2016 |
| WO | WO-2016062777 | A1 | 4/2016 |
| WO | WO-2016079589 | A1 | 5/2016 |
| WO | WO-2016162446 | A1 | 10/2016 |
| WO | WO-2016171997 | A2 | 10/2016 |
| WO | WO-2017035720 | A1 | 3/2017 |
| WO | WO-2017072148 | A1 | 5/2017 |
| WO | WO-2017072239 | A1 | 5/2017 |
| WO | WO-2017122196 | A1 | 7/2017 |
| WO | WO-2017129617 | A1 | 8/2017 |
| WO | WO-2017207418 | A1 | 12/2017 |
| WO | WO-2017207419 | A1 | 12/2017 |
| WO | WO-2017207582 | A1 | 12/2017 |
| WO | WO-2018019578 | A1 | 2/2018 |
| WO | WO-2018041065 | A1 | 3/2018 |
| WO | WO-2018122389 | A1 | 7/2018 |
| WO | WO-2018122978 | A1 | 7/2018 |
| WO | WO-2018206615 | A2 | 11/2018 |
| WO | WO-2019057942 | A1 | 3/2019 |
| WO | WO-2019073237 | A1 | 4/2019 |
| WO | WO-2019122015 | A1 | 6/2019 |
| WO | WO-2020025644 | A1 | 2/2020 |
| WO | WO-2020028591 | A1 | 2/2020 |
| WO | WO-2020239599 | A1 | 12/2020 |

OTHER PUBLICATIONS (2015) "Property Tables and Charts (SI Units)", Wright State University, p. 865-892.

* cited by examiner

VAPORIZER DEVICE AND CARTRIDGE

CROSS-REFERENCE TO RELATED APPLICATIONS

This application is a continuation application of International Patent Application No. PCT/US20/15091 filed on Jan. 24, 2020 which claims priority to U.S. Provisional Application No. 62/797,037, filed on Jan. 25, 2019, and titled "Vaporizer Device and Cartridge," the entirety of which is incorporated by reference herein in its entirety.

TECHNICAL FIELD

The subject matter described herein relates to vaporizer devices and cartridges, including vaporizer devices and cartridges having a tobacco-based wicking element.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some implementations, the vaporizable material can be drawn out of a reservoir and into the vaporization chamber via a wicking element (e.g., a wick). Drawing the vaporizable material into the vaporization chamber can be at least partially due to capillary action provided by the wick, as the wick pulls the vaporizable material along the wick in the direction of the vaporization chamber. However, as vaporizable material is drawn out of the reservoir, the pressure inside the reservoir is reduced, thereby creating a vacuum and acting against the capillary action. This can reduce the effectiveness of the wick to draw the vaporizable material into the vaporization chamber, thereby reducing the effectiveness of the vaporization device to vaporize a desired amount of vaporizable material, such as when a user takes a puff on the vaporizer device. Furthermore, the vacuum created in the reservoir can ultimately result in the inability to draw all of the vaporizable material into the vaporization chamber, thereby wasting vaporizable material. As such, improved vaporization devices and/or vaporization cartridges that improve upon or overcome these issues is desired.

Generally, the vaporizable material may include a certain concentration of nicotine and optionally a particular flavoring to enhance the user's experience. However, in some instances, the vaporizable material may not provide natural flavors and/or a natural source of nicotine. Additionally, many wicking elements used in vaporizer devices may simply act as a medium through which vaporizable material is drawn from the reservoir to be vaporized and inhaled by the user. The wicking elements may not provide a source of flavor or nicotine instead of or in addition to the flavoring and/or nicotine content provided by the vaporizable material.

Moreover, vaporizer devices may not be able to accommodate more than one type of cartridge. For instance, vaporizer devices may be capable of only be capable of accommodating a vaporizer cartridge of a single type (e.g., a vaporizer cartridge having a particular type of wicking element), rather than more than one type of vaporizer cartridge (e.g., a vaporizer cartridge having a tobacco-based wicking element and a vaporizer cartridge having another type of wicking element). Many vaporizer devices do not allow for various types of vaporizer cartridges to be interchanged due to certain device and/or controller limitations.

Vaporizer devices can be controlled by one or more controllers, electronic circuits (for example, sensors, heating elements), and/or the like on the vaporizer. Vaporizer devices can also wirelessly communicate with an external controller for example, a computing device such as a smartphone).

SUMMARY

In certain aspects of the current subject matter, challenges associated with the limitations of conventional wicking elements, vaporizer devices, and vaporizer cartridges can be addressed by the inclusion of one or more of the features described herein. Aspects of the current subject matter are related to a vaporizer device and cartridge including a wicking element. In one aspect, a wicking element made of tobacco or a tobacco-based composition blend is described.

In some variations one or more of the following features may optionally be included in any feasible combination. The device can include a wicking element configured for use in a vaporizer device. The wicking element can be composed, at least partially, of tobacco.

In some variations, the wicking element can be further composed of a tobacco composition including at least tobacco and a fibrous material.

In some variations, the fibrous material incudes cotton fiber. In other variations, the fibrous material includes hemp fiber.

In some variations, the tobacco includes a tobacco blend and a binder.

According to some variations, a method of manufacturing a wicking element includes forming a first portion of the wicking element to include a tobacco. The method may further include adhering the first portion of the wicking element to a second portion of the wicking element comprising a fibrous material.

In some variations, the first portion of the wicking element may be formed by at least blending a first tobacco material with a second tobacco material to form a blended tobacco material. The forming may include priming the blended tobacco material by applying a vaporizable material to the blended tobacco material. The forming may also include applying a binder to the blended tobacco to form the first portion of the wicking element. The forming may further include extruding the first portion of the wicking element. The forming may further include dehydrating the first portion of the wicking element.

In some variations, the adhering further includes applying a vaporizable material to the first portion of the wicking element. The adhering may also include dehydrating the first portion of the wicking element and the second portion of the wicking element.

In some variations, a vaporizer cartridge may include a reservoir, a wicking element, and a heating element. The reservoir may be configured to contain a vaporizable material. The wicking element may draw vaporizable material from the reservoir. The wicking element may include tobacco. The heating element may be coupled with the wicking element and heat the wicking element to cause vaporizable material to vaporize.

In some variations, the heating element is crimped about the wicking element. In some variations, the wicking element further includes a fibrous material coupled with the tobacco.

According to some variations, a method of assembling a vaporizer cartridge comprising a reservoir configured to contain a vaporizable material includes crimping a heating element about a wicking element. The wicking element may include tobacco. The method may further include inserting the heating element and the wicking element into an end of the reservoir. The method may further include securing the heating element and the wicking element within the reservoir with a grill. The method may further include providing vaporizable material to the reservoir. The method may further include coupling a mouthpiece to another end of the reservoir.

According to some variations, a vaporizer device includes a vaporizer body having a cartridge receptacle. The cartridge receptacle may receive a first vaporizer cartridge comprising a first wicking element at least partially composed of tobacco. The cartridge receptacle may also receive a second vaporize cartridge comprising a second wicking element composed of cotton. The vaporizer body may detect whether the first vaporizer cartridge or the second vaporizer cartridge has been inserted into the cartridge receptacle. In some variations, a controller of the vaporizer body may adjust a heating temperature of a heating element of the vaporizer cartridge.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a cartridge (for example, a part of the vaporizer that contains the vaporizable material in a reservoir or other container) which can be refillable when empty, or disposable such that a new cartridge containing additional vaporizable material of a same or different type can be used). A vaporizer device can be a cartridge-using vaporizer device, a cartridge-less vaporizer device, or a multi-use vaporizer device capable of use with or without a cartridge. For example, a vaporizer device can include a heating chamber (for example, an oven or other region in which material is heated by a heating element) configured to receive a vaporizable material directly into the heating chamber, and/or a reservoir or the like for containing the vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself), a paste, a wax, and/or a solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

Figure 1A:
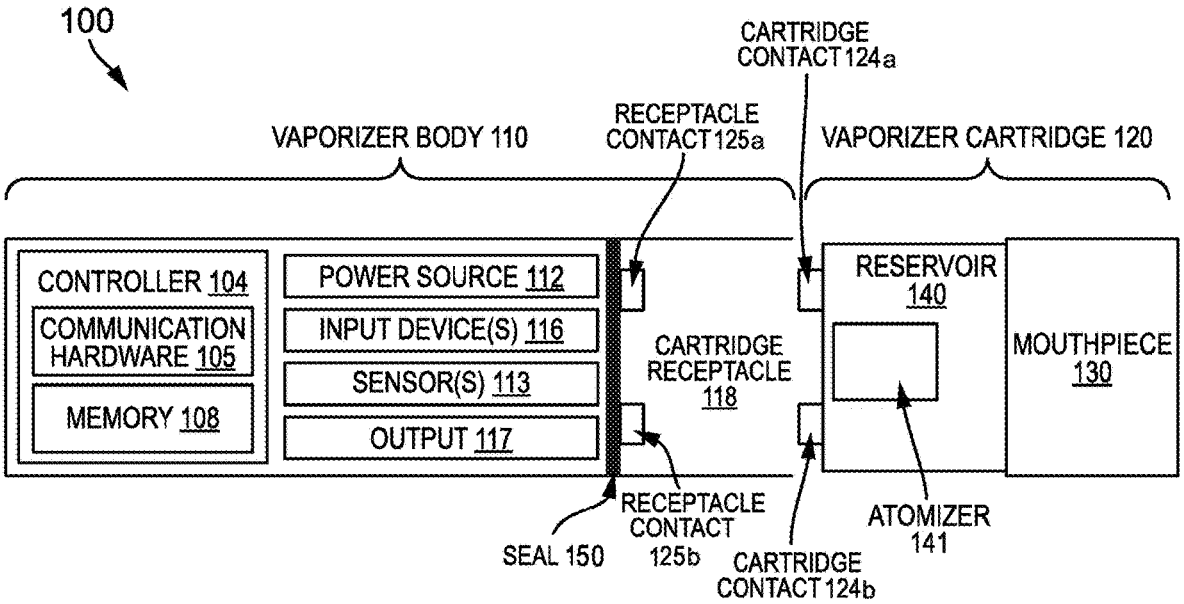
FIG. 1A is a block diagram of a vaporizer device.

Referring to the block diagram of FIG. 1A, a vaporizer device 100 can include a power source 112 (for example, a battery, which can be a rechargeable battery), and a controller 104 (for example, a processor, circuitry, etc. capable of executing logic) for controlling delivery of heat to an atomizer 141 to cause a vaporizable material 102 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter. After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer 141 can include a wicking element (i.e., a wick) configured to convey an amount of the vaporizable material 102 to a part of the atomizer 141 that includes a heating element (not shown in FIG. 1A).

For example, the wicking element can be configured to draw the vaporizable material 102 from a reservoir 140 configured to contain the vaporizable material 102, such that the vaporizable material 102 can be vaporized by heat delivered from a heating element included in the atomizer 141. The wicking element can also optionally allow air to enter the reservoir 140 and replace the volume of vaporizable material 102 removed. In some implementations of the current subject matter, capillary action can pull vaporizable material 102 into the wick for vaporization by the heating element, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the atomizer 141 can include a heating element which includes a resistive coil or other heating element wrapped around, positioned within, integrated into a bulk shape of, pressed into thermal contact with, or otherwise arranged to deliver heat to a wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer assembly configurations are also possible.

Certain vaporizer devices may, additionally or alternatively, be configured to create an inhalable dose of the vaporizable material 102 in the gas phase and/or aerosol phase via heating of the vaporizable material 102. The vaporizable material 102 can be a solid-phase material (such as a wax or the like) or plant material (for example, tobacco leaves and/or parts of tobacco leaves). In such vaporizer devices, a resistive heating element can be part of, or otherwise incorporated into or in thermal contact with, the walls of an oven or other heating chamber into which the vaporizable material 102 is placed. Alternatively, a resistive heating element or elements can be used to heat air passing through or past the vaporizable material 102, to cause convective heating of the vaporizable material 102. In still other examples, a resistive heating element or elements can be disposed in intimate contact with plant material such that direct conductive heating of the plant material occurs from within a mass of the plant material, as opposed to only by conduction inward from walls of an oven.

The heating element can be activated in association with a user puffing (i.e., drawing, inhaling, etc.) on a mouthpiece 130 of the vaporizer device 100 to cause air to flow from an air inlet, along an airflow path that passes the atomizer 141 (i.e., wicking element and heating element). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element can be activated via the controller 104, which can optionally be a part of a vaporizer body 110 as discussed herein, causing current to pass from the power source 112 through a circuit including the resistive heating element, which is optionally part of a vaporizer cartridge 120 as discussed herein. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element can be caused by automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of the heating element of the vaporizer device 100 can depend on a number of factors, including an amount of electrical power delivered to the heating element and/or a duty cycle at which the electrical power is delivered, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (i.e., air moving across the heating element or the atomizer 141 as a whole when a user inhales on the vaporizer device 100). As noted herein, to reliably activate the heating element or heat the heating element to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element can be activated in association with a user's puff, for example by automatic detection of the puff, or by the sensor 113 detecting a change (such as a pressure change) in the airflow path.

The sensor 113 can be positioned on or coupled to (i.e., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 150 resilient enough to separate an airflow path from other parts of the vaporizer device 100. The seal 150, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer, the seal 150 can also separate parts of one or more electrical connections between the vaporizer body 110 and the vaporizer cartridge 120. Such arrangements of the seal 150 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 150 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 150, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and a heating element. Alternatively, one or both of the wicking element and the heating element can be part of the vaporizer body 110. In implementations in which any part of the atomizer 141 (i.e., heating element and/or wicking element) is part of the vaporizer body 110, the vaporizer device 100 can be configured to supply vaporizable material 102 from the reservoir 140 in the vaporizer cartridge 120 to the part(s) of the atomizer 141 included in the vaporizer body 110.

Cartridge-based configurations for the vaporizer device 100 that generate an inhalable dose of a vaporizable material 102 that is not a liquid, via heating of a non-liquid material, are also within the scope of the current subject matter. For example, the vaporizer cartridge 120 can include a mass of a plant material that is processed and formed to have direct contact with parts of one or more resistive heating elements, and the vaporizer cartridge 120 can be configured to be coupled mechanically and/or electrically to the vaporizer body 110 that includes the controller 104, the power source 112, and one or more receptacle contacts 125*a* and 125*b* configured to connect to one or more corresponding cartridge contacts 124*a* and 125*b* and complete a circuit with the one or more resistive heating elements.

In an embodiment of the vaporizer device 100 in which the power source 112 is part of the vaporizer body 110, and a heating element is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element (for example, a heating element within the atomizer 141). These features can include one or more contacts (referred to herein as cartridge contacts 124*a* and 124*b*) on a bottom surface of the vaporizer cartridge 120 and at least two contacts (referred to herein as receptacle contacts 125*a* and 125*b*) disposed near a base of the cartridge receptacle 118 of the vaporizer device 100 such that the cartridge contacts 124*a* and 124*b* and the receptacle contacts 125*a* and 125*b* make electrical connections when the vaporizer cartridge 120 is inserted into and coupled with the cartridge receptacle 118. The circuit completed by these electrical connections can allow delivery of electrical current to the resistive heating element and may further be used for additional functions, such as measuring a resistance of the resistive heating element for use in determining and/or controlling a temperature of the heating element based on a thermal coefficient of resistivity of the heating element, for identifying a cartridge based on one or more electrical characteristics of a heating element or the other circuitry of the vaporizer cartridge, etc.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
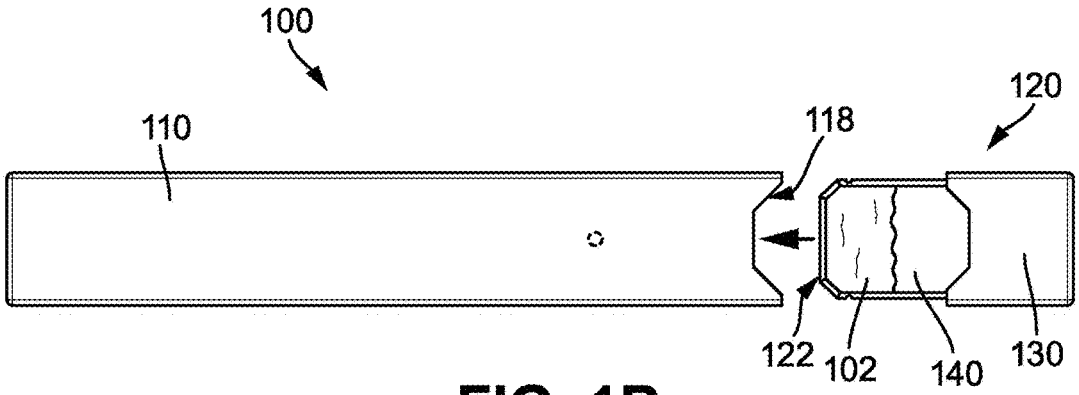
FIG. 1B is a schematic representation of a vaporizer device and vaporizer cartridge.

FIG. 1B illustrates an embodiment of the vaporizer body 110 and the cartridge receptacle 118 into which the vaporizer cartridge 120 can be releasably inserted. FIG. 1B shows a top view of the vaporizer device 100 illustrating the vaporizer cartridge 120 positioned for insertion into the vaporizer body 110. When a user puffs on the vaporizer device 100, air can pass between an outer surface of the vaporizer cartridge 120 and an inner surface of the cartridge receptacle 118 on the vaporizer body 110. Air can then be drawn into the insertable end 122 of the cartridge, through the vaporization chamber that includes or contains the heating element and wick, and out through an outlet of the mouthpiece 130 for delivery of the inhalable aerosol to a user. The reservoir 140 of the vaporizer cartridge 120 can be formed in whole or in part from translucent material such that a level of the vaporizable material 102 is visible within the vaporizer cartridge 120. The mouthpiece 130 can be a separable component of the vaporizer cartridge 120 or can be integrally formed with other component(s) of the vaporizer cartridge 120 (for example, formed as a unitary structure with the reservoir 140 and/or the like).

Further to the discussion above regarding the electrical connections between the vaporizer cartridge 120 and the vaporizer body 110 being reversible such that at least two rotational orientations of the vaporizer cartridge 120 in the cartridge receptacle 118 are possible, in some embodiments of the vaporizer device 100, the shape of the vaporizer cartridge 120, or at least a shape of the insertable end 122 of the vaporizer cartridge 120 that is configured for insertion into the cartridge receptacle 118, can have rotational symmetry of at least order two. In other words, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

Figure 1C:
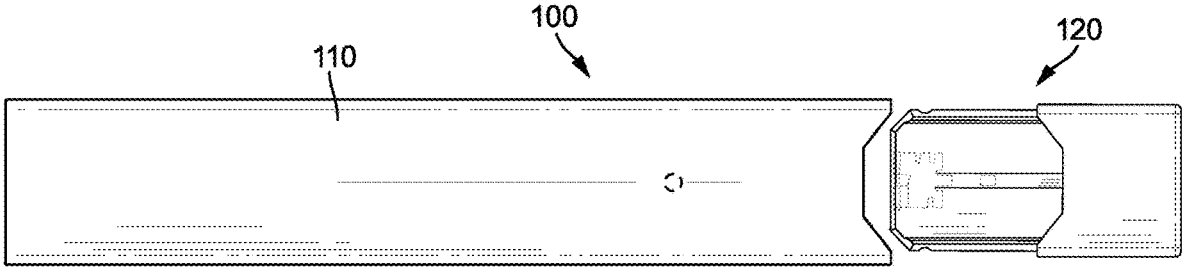
FIG. 1C is a front view of a vaporizer device and an embodiment of a vaporizer cartridge.
Figure 1D:
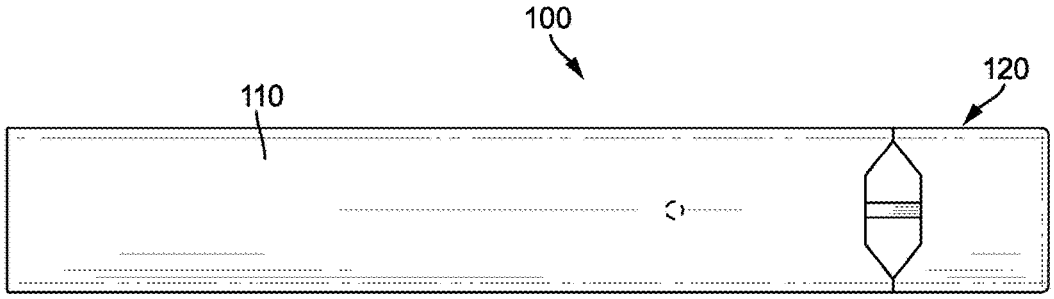
FIG. 1D is a front view of a vaporizer cartridge coupled to a vaporizer device.

FIGS. 1C-1D illustrate example features that can be included in embodiments of the vaporizer device 100 consistent with implementations of the current subject matter. FIGS. 1C and 1D show top views of an example of the vaporizer device 100 before (FIG. 1C) and after (FIG. 1D) connecting the vaporizer cartridge 120 to the vaporizer body 110.

Figure 1E:
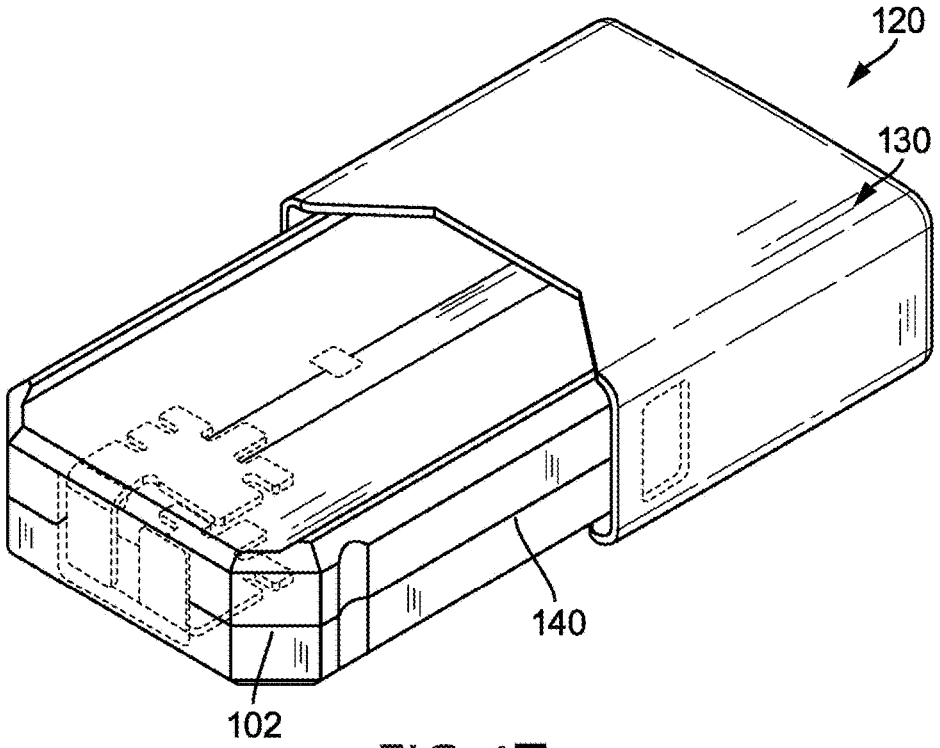
FIG. 1E is a perspective view of a vaporizer cartridge.

FIG. 1E illustrates a perspective view of one variation of the vaporizer cartridge 120 holding the vaporizable material 102. Any appropriate vaporizable material 102 can be contained within the vaporizer cartridge 120 (for example, within the reservoir 140), including solutions of nicotine or other organic materials.

Figure 1F:
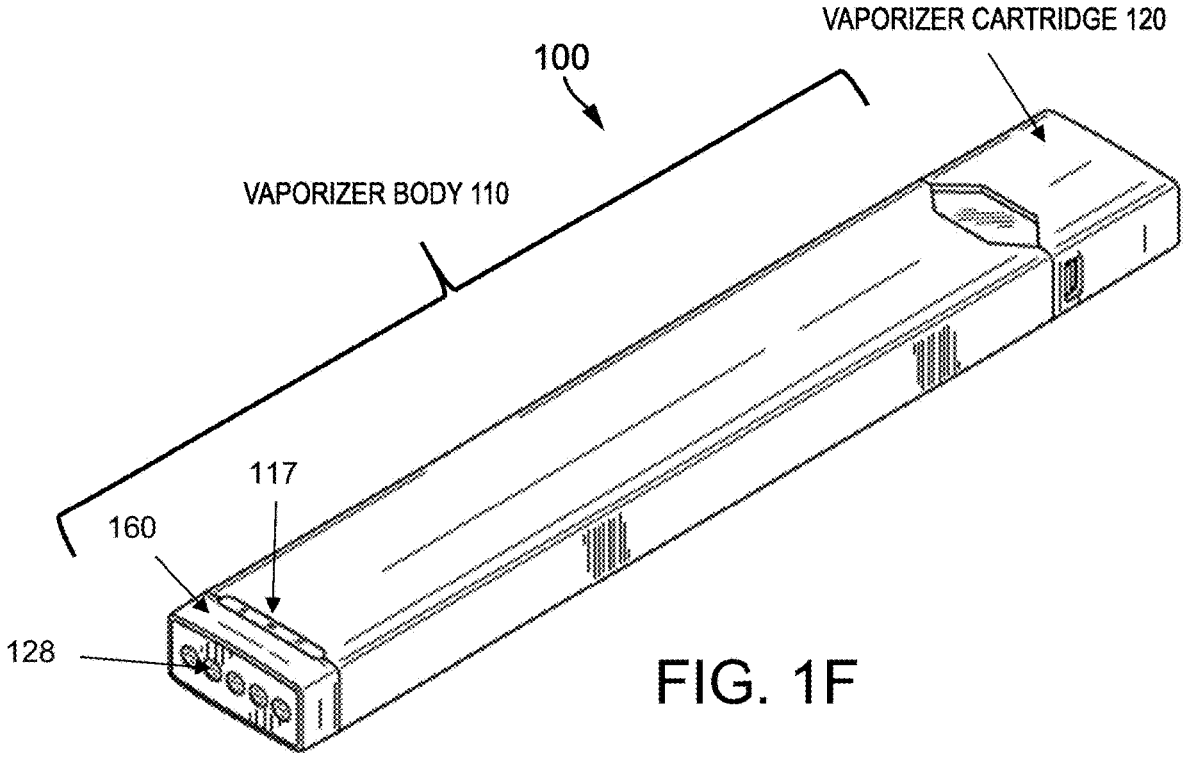
FIG. 1F is a perspective view of another embodiment of a vaporizer cartridge coupled to a vaporizer device.

FIG. 1F shows a perspective view of another example of a vaporizer device 100 including a vaporizer body 110 coupled to a separable vaporizer cartridge 120. As illustrated, the vaporizer device 100 can include one or more outputs 117 configured to provide one or more visual indicators, audio indicators, and/or haptic indicators. The one or more outputs 117 may generate the indicators based on a status, mode of operation, and/or the like, of the vaporizer device 100. In some aspects, the one or more outputs 117 can include a plurality of LEDs (i.e., two, three, four, five, or six LEDs). The one or more outputs 117 (i.e., each individual LED) can be configured to display light in one or more colors (for example, white, red, blue, green, yellow, etc.). The one or more outputs 117 can be configured to display different light patterns (for example, by illuminating specific LEDs, varying a light intensity of one or more of the LEDs over time, illuminating one or more LEDs with a different color, and/or the like) to indicate different statuses, modes of operation, and/or the like of the vaporizer device 100. In some implementations, the one or more outputs 117 can be proximal to and/or at least partially disposed within a bottom end region 160 of the vaporizer device 100. The vaporizer device 100 may, additionally or alternatively, include externally accessible charging contacts 128, which can be proximate to and/or at least partially disposed within the bottom end region 160 of the vaporizer device 100.

FIGS. 2-11 illustrate an example of the vaporizer cartridge 120. The vaporizer cartridge 120 may include a reservoir 140 (which includes an air passageway 212), a grill 206, a heating element 208, and a wicking element 202. The reservoir 140 may also include a first end 224 configured to be coupled with the mouthpiece 130, and a second end 222 opposite the first end 224 and configured to be coupled with the vaporizer body 110 (see FIG. 4).

The wicking element 202 may include any material capable of causing fluid motion by capillary pressure through the wick to convey an amount of a liquid vaporizable material to a part of the atomizer 141 that includes a heating element. As noted above, the wicking element 202 may draw vaporizable material from a reservoir 140 that contains the vaporizable material, so that the vaporizable material may be vaporized by heat delivered from the heating element 208 to the wicking element 202. In some implementations, air may return to the reservoir 140 through the air passageway 212 (and wicking element 202) or other opening to at least partially equalize pressure in reservoir 140.

The wicking element 202 can be composed at least partially, of tobacco. A tobacco-based wicking element provides a natural source of nicotine and tobacco flavoring. Thus, a wicking element composed at least partially of tobacco may provide an enhanced user experience and flavor profile for the user when operating the vaporizer device 100. The tobacco-based wicking element may also enhance the user experience by providing an appearance of tobacco or a tobacco-based product.

Though in some implementations the wicking element 202 may be made entirely of tobacco, in other implementations, the wicking element 202 can be made of a composite blend including one or more types of tobacco blended, and formed with one or more other materials, such as one or more fibrous materials. The one or more fibrous materials may aid in improving absorption of the vaporizable material by the wicking element 202. For example, the composite blend may include tobacco and one or more other rigid or compressible fibrous materials, such as cotton, hemp, silica, ceramic, and/or the like. In particular, relative to some other materials, a composite blend including tobacco and cotton may allow for an increased and/or more controllable flow rate of vaporizable material from the reservoir 140 into the wicking element 202 to be vaporized.

The wicking element 202 may form an extruded sheet. The wicking element 202 may also take the form of other various shapes and sizes. For example, the wicking element 202 may form a flat pad, a puck, a sphere, a cylinder, and/or the like. Various methods of forming the wicking element are described in more detail below.

Figure 2:
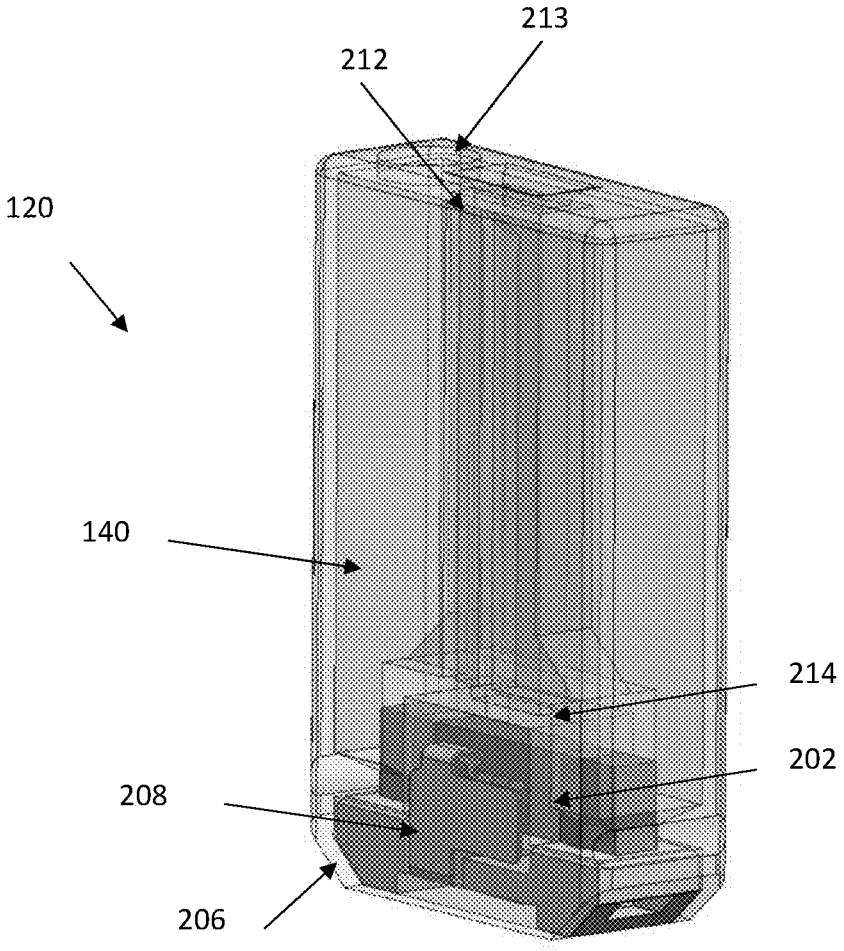
FIG. 2 illustrates a perspective view of a portion of an example vaporizer cartridge consistent with implementations of the current subject matter.
Figure 3:
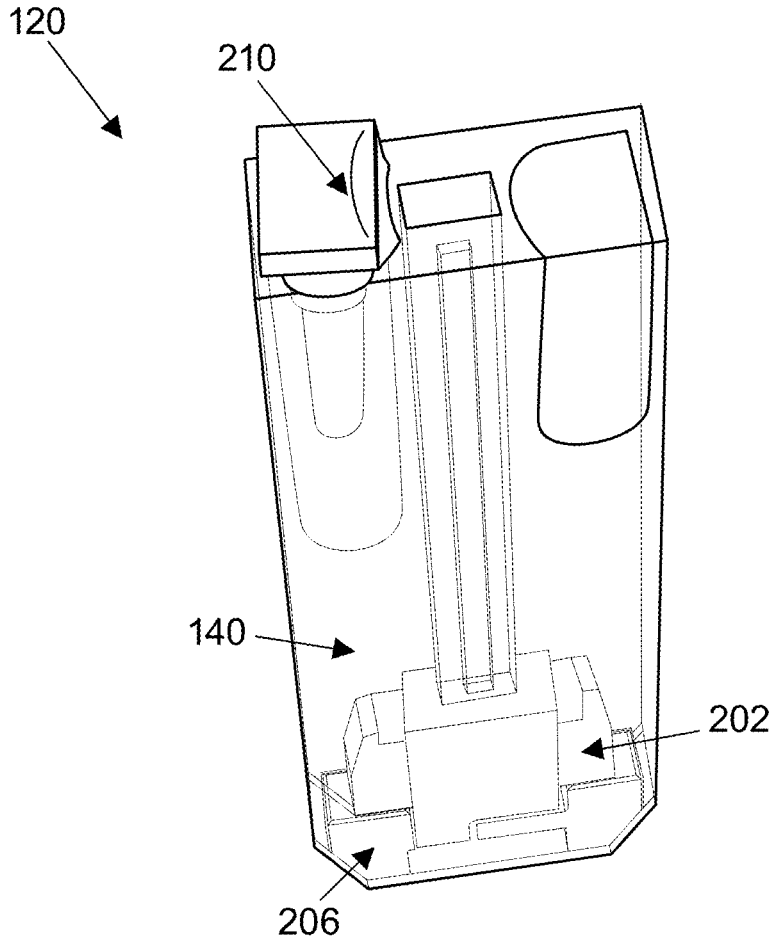
FIG. 3 illustrates a perspective view of a portion of an example vaporizer cartridge consistent with implementations of the current subject matter.
Figure 4:
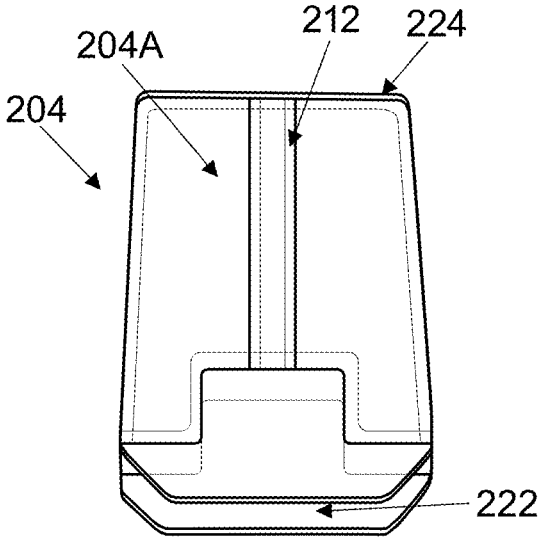
FIG. 4 illustrates an example reservoir of a vaporizer cartridge consistent with implementations of the current subject matter.

Referring to FIGS. 2 and 3, the air passageway 212 of the reservoir 140 may be formed through a portion of the reservoir 140, such as through a center of the reservoir 140. The air passageway 212 may connect an area in the vaporizer cartridge 120 that houses the wicking element 202 (e.g., a wick housing 214) to an opening that leads to the mouthpiece 130 to provide a route for the vaporized vaporizable material to travel from the atomizer, which includes the heating element 208, to the mouthpiece 130.

Figure 10:
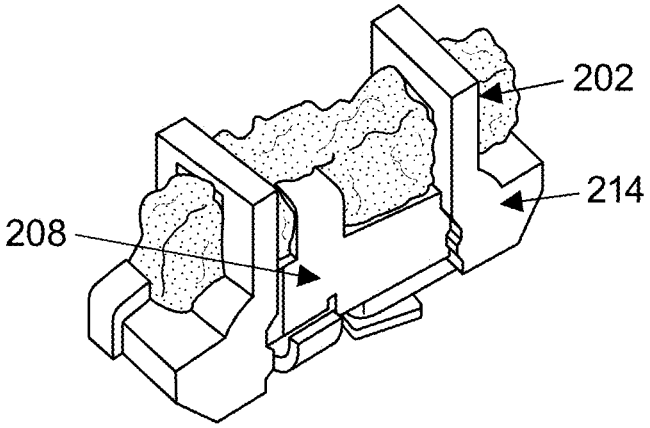
FIG. 10 illustrates an example of a heating element and a wicking element consistent with implementations of the current subject matter.
Figure 11:
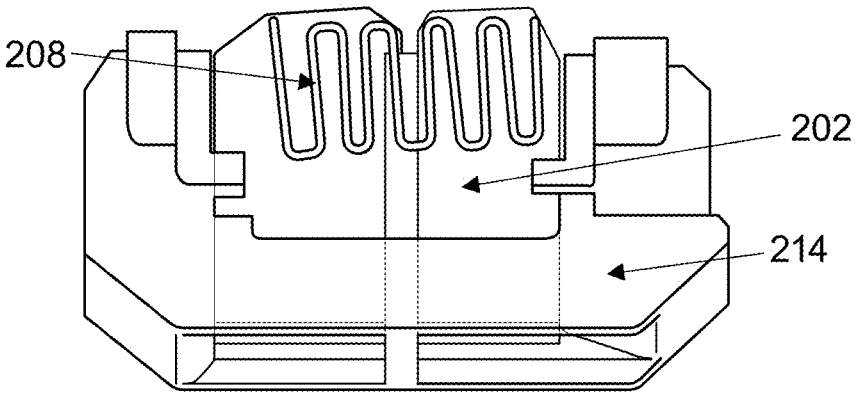
FIG. 11 illustrates another example of a heating element and a wicking element consistent with implementations of the current subject matter.

As noted above, the wicking element 202 may be coupled to the atomizer 141 (and heating element 208 (e.g., a resistive heating element or coil)) that is connected to one or more electrical contacts. The heating element 208 may have various shapes and/or configurations. For example, the heating element 208 of the vaporizer cartridge consistent with one or more implementations may be made (e.g., stamped) from a sheet of material and either crimped around at least a portion of the wicking element 202 or bent to provide a preformed element configured to receive the wicking element 202 (e.g., the wicking element is pushed into the heating element and/or the heating element is held in tension and is pulled over the wicking element). Thus, the heating element 208 may be bent such that the heating element 208 secures the wicking element 202 between at least two or three portions of the heating element 208. The heating element 208 may be bent to conform to a shape of at least a portion of the wicking element 202. FIGS. 10 and 11 illustrate an example of the wicking element 202 coupled with the heating element 208. As shown in FIGS. 10 and 11, the wicking element 202 is positioned within at least a portion of the heating element 208.

In some implementations, the wick housing 214 may surround at least a portion of the heating element 208 and the wicking element 202 and connect the heating element 208 and the wicking element 202 directly or indirectly with the air passageway 212. FIGS. 10 and 11 illustrate an example of the wick housing 214 coupled with the heating element 208 and the wicking element 202. For example, the wick housing 214 surrounds at least a portion of the wicking element 202 and the heating element 208.

In some implementations, the flow of vaporizable material toward and into wicking element 202 may be controllable by at least one or more of: the material construction of wicking element 202 (e.g., tobacco and/or fibrous material), perforations in wicking element 202, openings in the wick housing or region, and/or the grill 206. For example, the grill 206 (see FIG. 6) may secure the heating element 208 and the wicking element 202 within the reservoir 140. The grill may fit at least partially over or within a second end 222 of a vaporizer cartridge body 204A of the vaporizer cartridge 204. The grill 206 may include one or more (e.g., one, two, three, four, or more) perforations 216 that help to control the flow of vaporizable material from the reservoir 140 to the wicking element 202 and/or air through the vaporizer cartridge 120.

Generally, when a user inhales from the mouthpiece 130, for example, air flows into the vaporizer cartridge 120 through an inlet or opening in operational relationship with the wicking element 202. The heating element 208 may be activated in response to a signal generated by one or more sensors 113 (see FIG. 1A). The one or more sensors 113 may include at least one of a pressure sensor, motion sensor, flow sensor, or other mechanism capable of detecting changes in the air passageway 212. When the heating element 208 is activated, the heating element 208 may experience a temperature increase as a result of current flowing from the power source. Depending on the type of wicking element, the heating element may be heated to a certain temperature to vaporize the vaporizable material from the wicking element. For example, a tobacco-based wicking element may be heated to a temperature lower than a temperature that a wicking element composed of another material, such as cotton, hemp, silica, ceramic, and/or the like, would be heated to. The desired temperature to which the heating element is heated may depend on the material construction of wicking element 202 (e.g., tobacco and/or fibrous material), a porosity of the wicking element 202, a density of the wicking element 202, perforations in wicking element 202, openings in the wick housing 214, and/or the like.

The generated heat may be transferred to at least a portion of vaporizable material in the wicking element 202 through conductive, convective, or radiative heat transfer such that at least a portion of vaporizable material drawn into wicking element 202 is vaporized. Depending on implementation, air entering the vaporizer cartridge flows over the wicking element 202 and the heating element 208 and strips away the vaporized vaporizable material into the air passageway 212, where the vapor is condensed and delivered in aerosol form, for example, through an opening in the mouthpiece 130. As the wicking element 202 may be at least partially made of tobacco, nicotine and/or flavoring from the tobacco may be vaporized and/or mixed with the vaporizable material and inhaled by the user, thereby providing the user with an enhanced user experience.

Figure 7:
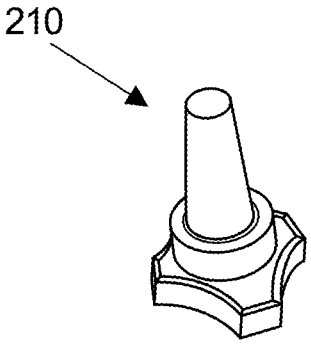
FIG. 7 illustrates an example stopper for a reservoir of a vaporizer cartridge consistent with implementations of the current subject matter.
Figure 8:
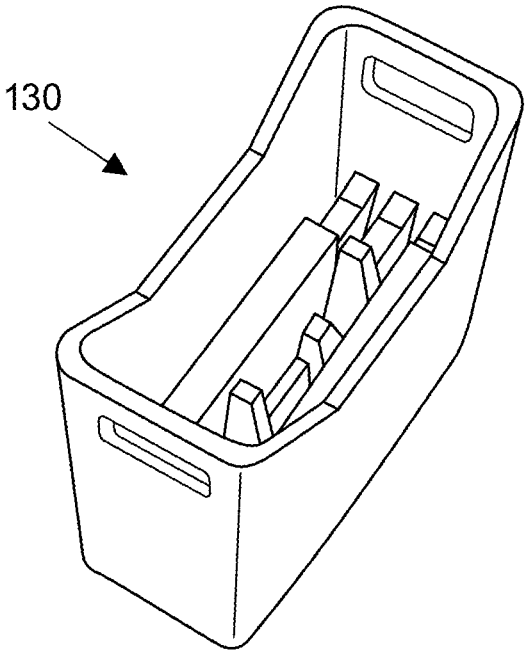
FIG. 8 illustrates an example of a mouthpiece for a vaporizer cartridge consistent with implementations of the current subject matter.
Figure 9:
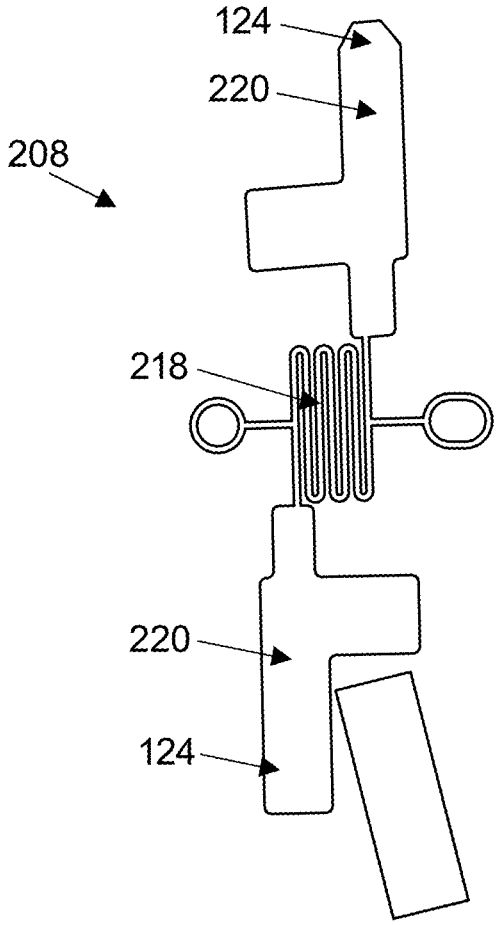
FIG. 9 illustrates an example of a heating element for a vaporizer cartridge consistent with implementations of the current subject matter.

Referring to FIG. 3, the reservoir 140 may include a fill port 213. The fill port 213 may be implemented in one or more embodiments of vaporizer cartridge 120 to allow for filling the reservoir 140 by way of, for example, a fill needle. FIG. 7 illustrates an example of a stopper 210 that may be placed in the fill port 213 to prevent the vaporizable material from leaking out of the fill port 213. As described in more detail below, the mouthpiece 130, such as the mouthpiece 130 shown in FIG. 8, may be positioned over the open end of the reservoir 140 when the stopper is appropriately placed.

The vaporizer cartridge can be manufactured in various manners. First the wicking element 202 may be coupled with the heating element 208. In some implementations, the wicking element and heating element 208 may be coupled with the wick housing 214. Then, the wicking element-heating element structure may be inserted into and/or coupled with the reservoir.

For example, FIG. 10 illustrates an example method 1000 for assembling the vaporizer cartridge 120. At 1002, the wicking element 202 and the heating element 208 may be coupled. To couple the heating element 208 with the wicking element 202, the wicking element 208 may be positioned across a heater portion 218 of the heating element 208. Once the wicking element 208 is appropriately positioned, legs 220 of the heating element may be folded towards one another, about the wicking element 202 such that the heating element 208 is crimped about the wicking element 202. As noted above, the heating element 208 may be bent such that the heating element 208 secures the wicking element 202 and contacts the wicking element 202 along at least two or three portions of the heating element 208. Thus, the heating element 208 may be bent to conform to a shape of at least a portion of the wicking element 202, and the wicking element 202 may be at least partially compressed within the heating element 208. Crimping the heating element 208 about the wicking element 202 can help to maintain consistent contact between the heater portion 218 of the heating element 208 with the wicking element 202, and to maximize efficiency when vaporizing the vaporizable material from the wicking element 202.

At 1004, the heating element-wicking element structure may be inserted into the second end 222 of the reservoir 140. Upon insertion of the heating element-wicking element structure into the reservoir 140, ends of the wicking element may be at least partially compressed. The heating element-wicking element structure may be positioned such that at least a portion of the wicking element 202 is housed by the wick housing 214, and at least a portion of the legs 220 (e.g., the cartridge contacts 124*a*, 124*b*) extend externally relative to the second end of the reservoir 140.

At 1006, the grill 206 may be coupled with the reservoir 140. For example, the grill may be inserted into the second end of the reservoir 140 to secure at least a portion of the wicking element 202 and/or the heating element 208. Thus, in some implementations, the grill 206 and the wick housing 214 surround and/or secure the wicking element 202 and/or the heating element 208 within the reservoir 140. In some implementations, the grill 206 includes openings, through which at least a portion of the legs 220 (e.g., the cartridge contacts 124*a*, 124*b*) can pass through. Once the grill 206 is properly positioned within the reservoir 140, the cartridge contacts 124*a*, 124*b* may be folded over an externally facing side of the grill 206 until the cartridge contacts 124*a*, 124*b* are positioned approximately parallel to the second end of the reservoir 140. The heating element 208 may be tested to ensure that there are no irregularities (e.g., shorts or breaks) in the heating element 208.

At 1008, vaporizable material may be provided to the reservoir 140. For example, the vaporizable material may be provided to the reservoir 140 through the fill port 213, as discussed above. In implementations of the vaporizer cartridge 120 in which a stopper 210 is used, the stopper 210 may be inserted at least partially into the fill port 213 to plug the fill port opening.

At 1010, the mouthpiece 130 may be provided to the first end 224 of the reservoir to cover the first end 224.

In some implementations, in use, when a user puffs on the mouthpiece 130 of the vaporizer cartridge 120 once the vaporizer cartridge 120 is assembled, air flows into the vaporizer cartridge and along an air path. In association with the user puff, the heating element may be activated. Power can be supplied from the vaporizer body 110 to the heating element.

When the heating element is activated, a temperature increase can result due to current flowing (e.g., from the power source 112) through the heating element to generate heat. The heat is transferred to some amount of the vaporizable material absorbed by the wicking element 202 through conductive, convective, and/or radiative heat transfer such that at least a portion of the vaporizable material vaporizes. The heat transfer can occur to vaporizable material in the reservoir and/or to vaporizable material drawn into the wicking element 202 retained by the heating element. The air passing into the vaporizer device flows along the air path across the heating element, stripping away the vaporized vaporizable material from the heating element. The stripped away vaporized vaporizable material may include flavoring and/or nicotine from the tobacco of the tobacco-based wicking element 202 and/or from the vaporizable material in the reservoir 140. The vaporized vaporizable material can be condensed due to cooling, pressure changes, etc., such that it exits the mouthpiece 21 via the air passageway 212 as an aerosol for inhalation by a user.

Figure 12:
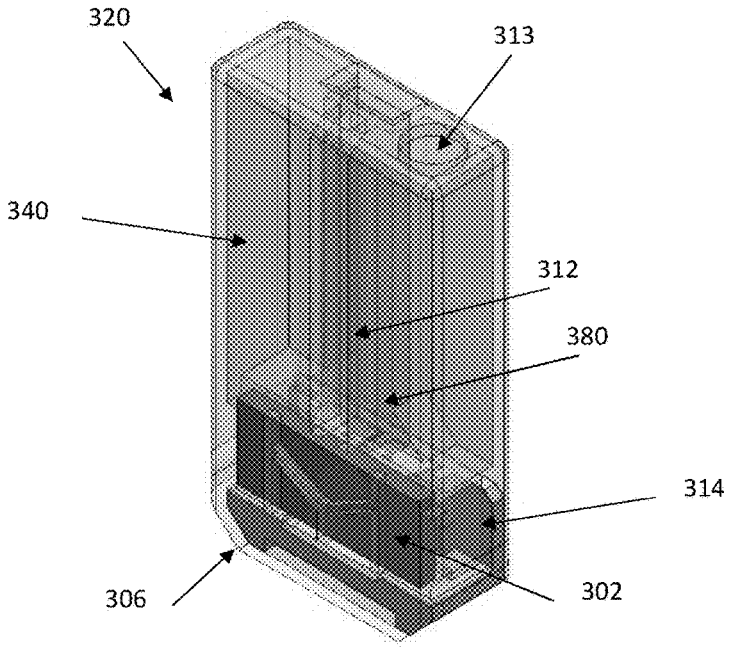
FIG. 12 illustrates an example vaporizer cartridge consistent with implementations of the current subject matter.
Figure 13:
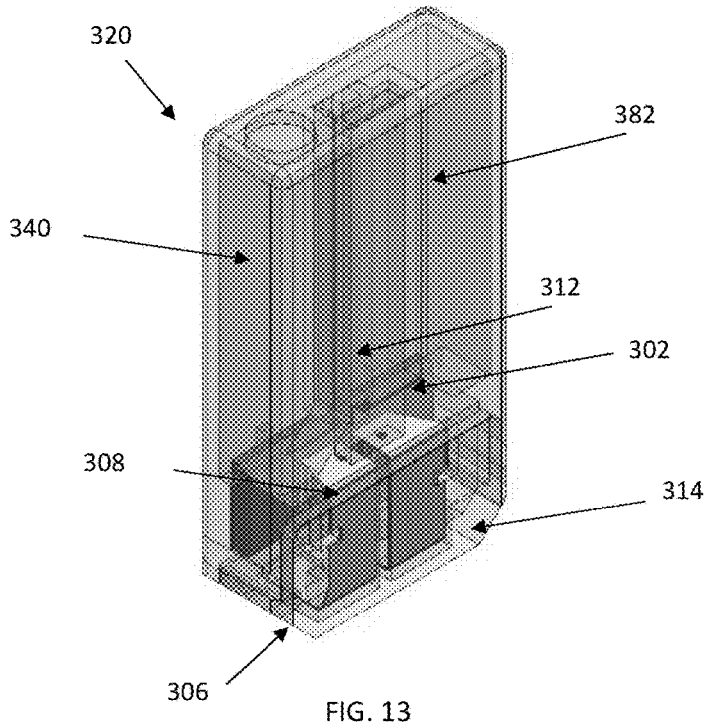
FIG. 13 illustrates an example vaporizer cartridge consistent with implementations of the current subject matter.

FIG. 12 and FIG. 13 illustrate an example vaporizer cartridge 320 consistent with implementations of the current subject matter. The vaporizer cartridge 320 includes the same or similar features as the vaporizer cartridge 120. For example, the vaporizer cartridge 320 includes a reservoir 340 (which includes an air passageway 312), a grill 306, a heating element 308, a wicking element 302, and a fill port 313, which may be the same or similar to the reservoir 140, the grill 206, the heating element 208, the wicking element 202, and the fill port 213, respectively. A mouthpiece (not shown) may be coupled to an end of the vaporizer cartridge 320 opposite the heating element 308.

The vaporizer cartridge 320 includes a wicking element 302 in the form of a puck, which may be positioned along a portion of a side, such as a first side 380, of the vaporizer cartridge 320. The heating element 308 may be positioned along a portion of another side, such as a second side 382, of the vaporizer cartridge 320, opposite the first side 380. In some implementations, the heating element 308 and/or the wicking element 302 may be at least partially supported by the wick housing 314.

As shown in FIGS. 12 and 13, the heating element 308 may be pressed against a portion of the wicking element 302. For example, the heating element 308 may apply a compression force to one side of the wicking element 302, rather than a compression force to two sides of the wicking element and/or a torsion force on the wicking element 302. Applying a compressive force to the wicking element 302, such as to one side of the wicking element 302 may improve the usable life of the wicking element 302 by reducing or eliminating the likelihood that the wicking element 302 will tear or otherwise become damaged when saturated with the fluid vaporizable material. This configuration may also improve the integrity of the wicking element.

In this implementation, an increased surface area of the wicking element 302 is exposed to and is in contact with the vaporizable material. The increased contact between the wicking element 302 and the vaporizable material stored within the reservoir 340 may allow for a greater amount of vaporizable material to be absorbed by or otherwise pass through the wicking element 302. Thus, a greater amount of vaporizable material may be vaporized from the wicking element 302, increasing the efficiency of vaporizing the vaporizable material and increasing the amount of vaporized vaporizable material per puff (e.g., an amount of total particulate matter). As shown in FIGS. 12 and 13, the wicking element 302 may be exposed to the vaporizable material stored within the reservoir 340 along opposing lateral sides of the wicking element 302. Since the wicking element 302 shown in FIGS. 12 and 13 may be formed of a flat pad shape, an increased surface area of the opposing lateral sides of the wicking element 302 may be in fluid communication with the vaporizable material stored within the reservoir 340. The increased exposure by the wicking element 302 to the vaporizable material may provide a larger area for fluid to flow into and re-saturate the wicking element 302 so that the wicking element 302 remains saturated in use. This may be especially useful when the wicking element 302 is composed at least partially of tobacco, to improve the saturation capability of the wicking element 302.

In some implementations, the reservoir 340 of the vaporizer cartridge 320 may have an increased capacity to increase a concentration of tobacco and/or nicotine that is delivered to the user when the user draws on the mouthpiece. The increased concentration of tobacco and/or nicotine may be due at least in part to the increased amount of vaporizable material capable of being stored within the reservoir 340 and/or vaporized by the heating element 308.

Figure 14:
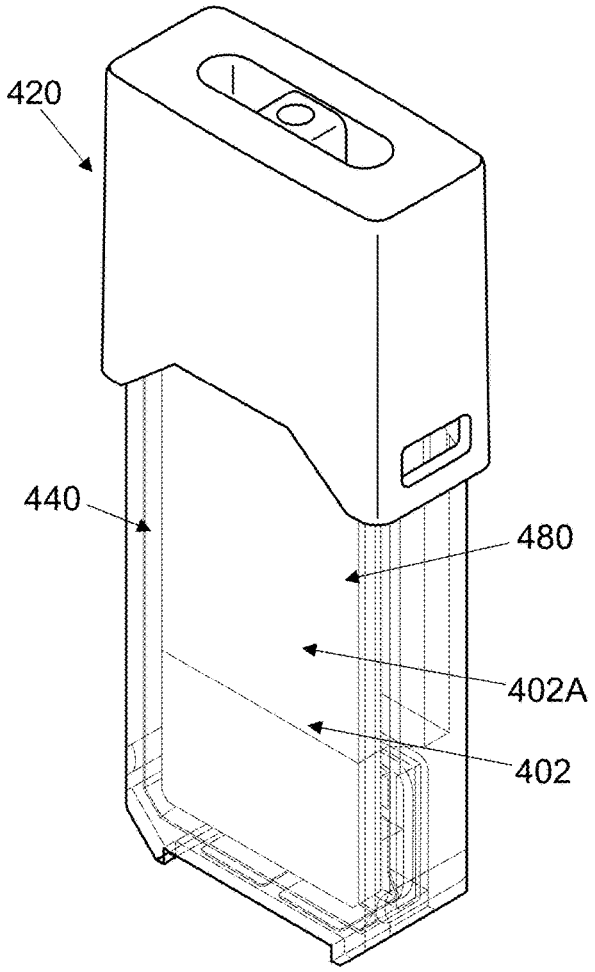
FIG. 14 illustrates an example vaporizer cartridge consistent with implementations of the current subject matter.
Figure 15:
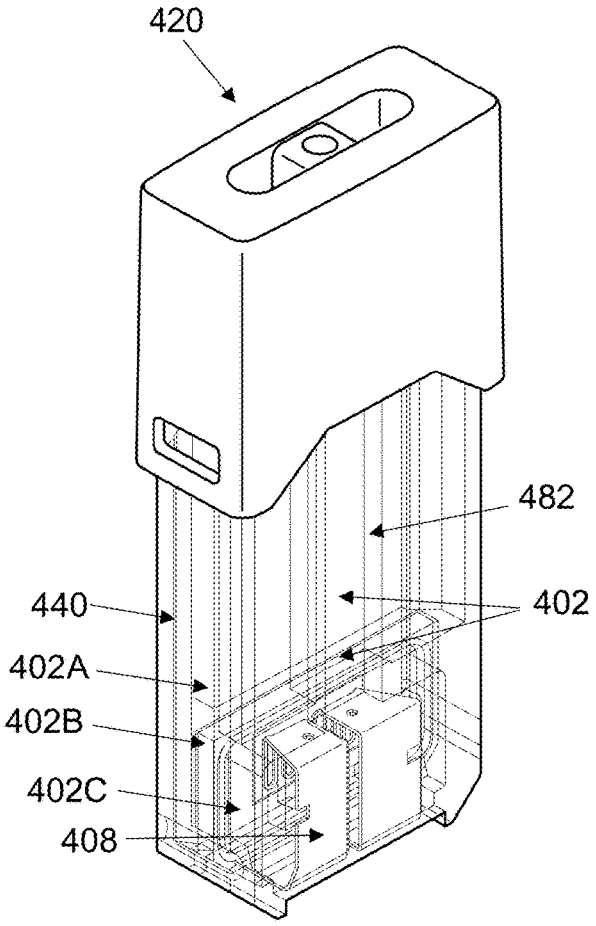
FIG. 15 illustrates an example vaporizer cartridge consistent with implementations of the current subject matter.

FIG. 14 and FIG. 15 illustrate an example vaporizer cartridge 420 consistent with implementations of the current subject matter. The vaporizer cartridge 420 includes the same or similar features as the vaporizer cartridge 120, 320 described herein. For example, the vaporizer cartridge 420 includes a reservoir 440, a heating element 408, and a wicking element 402, which may be the same or similar to the reservoir 140, 340, the heating element 208, 308, and the wicking element 202, 302, respectively. A mouthpiece (not shown) may be coupled to an end of the vaporizer cartridge 420 opposite the heating element 408.

The vaporizer cartridge 420 includes a wicking element 402 in the form of a puck, which may be positioned along a portion of a side, such as a first side 480, of the reservoir 440. As shown in FIG. 14, the puck may be positioned along the entire first side 480. In some implementations, the wicking element 408 includes a first puck 402A, a fibrous material 402B, and a second puck 402C. The fibrous material 402B may be positioned between the first puck 402A and the second puck 402C to enhance the absorption properties of the wicking element 402. The heating element 408 may be positioned along a portion of another side, such as a second side 482, of the reservoir 440, opposite the first side 480. In some implementations, the first puck 302A may be up to approximately 320 mg. This allows for a large amount of the puck (e.g., tobacco) to be visible through the reservoir 440 of the vaporizer cartridge 420, thereby enhancing the user experience.

As shown in FIGS. 14 and 15, the heating element 408 may be pressed against a portion of the wicking element 402. For example, the heating element 408 may apply a compression force to one side of the wicking element 402, rather than a compression force to two sides of the wicking element and/or a torsion force on the wicking element 402. Applying a compressive force to the wicking element 402, such as to one side of the wicking element 402 may improve the usable life of the wicking element 402 by reducing or eliminating the likelihood that the wicking element 402 will tear or otherwise become damaged when saturated with the fluid vaporizable material. This configuration may also improve the integrity of the wicking element 402.

In this implementation, an increased surface area of the wicking element 402 is exposed to and is in contact with the vaporizable material. The increased contact between the wicking element 402 (e.g., at least the first puck 402A) and the vaporizable material stored within the reservoir 440 may allow for a greater amount of vaporizable material to be absorbed by or otherwise pass through the wicking element 402. Thus, a greater amount of vaporizable material may be vaporized from the wicking element 402, increasing the efficiency of vaporizing the vaporizable material and increasing the amount of vaporized vaporizable material per puff (e.g., an amount of total particulate matter). As shown in FIGS. 14 and 15, the wicking element 402 may also be exposed to the vaporizable material stored within the reservoir 440 along opposing lateral sides of the wicking element 402. Since the wicking element 402 shown in FIGS. 14 and 15 may have a flat pad shape, an increased surface area of the opposing lateral sides of the wicking element 402 may be in fluid communication with the vaporizable material stored within the reservoir 440. The increased exposure by the wicking element 402 to the vaporizable material may provide a larger area for fluid to flow into and re-saturate the wicking element 402 so that the wicking element 402 remains saturated in use. This may be especially useful when the wicking element 402 is composed at least partially of tobacco, to improve the saturation capability of the wicking element 402.

In some implementations, the reservoir 440 of the vaporizer cartridge 420 may have an increased capacity to increase a concentration of tobacco and/or nicotine that is delivered to the user when the user draws on the mouthpiece. The increased concentration of tobacco and/or nicotine may be due at least in part to the increased amount of vaporizable material capable of being stored within the reservoir 440 and/or vaporized by the heating element 408.

Figure 16:
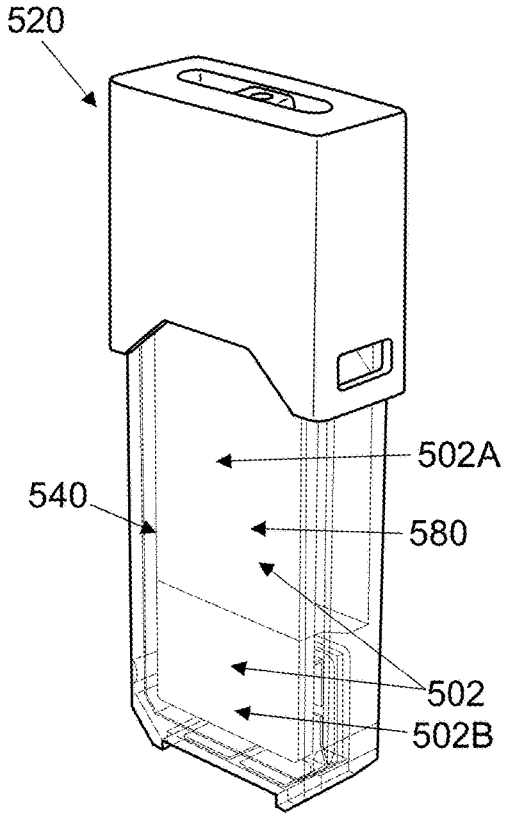
FIG. 16 illustrates an example vaporizer cartridge consistent with implementations of the current subject matter.
Figure 17:
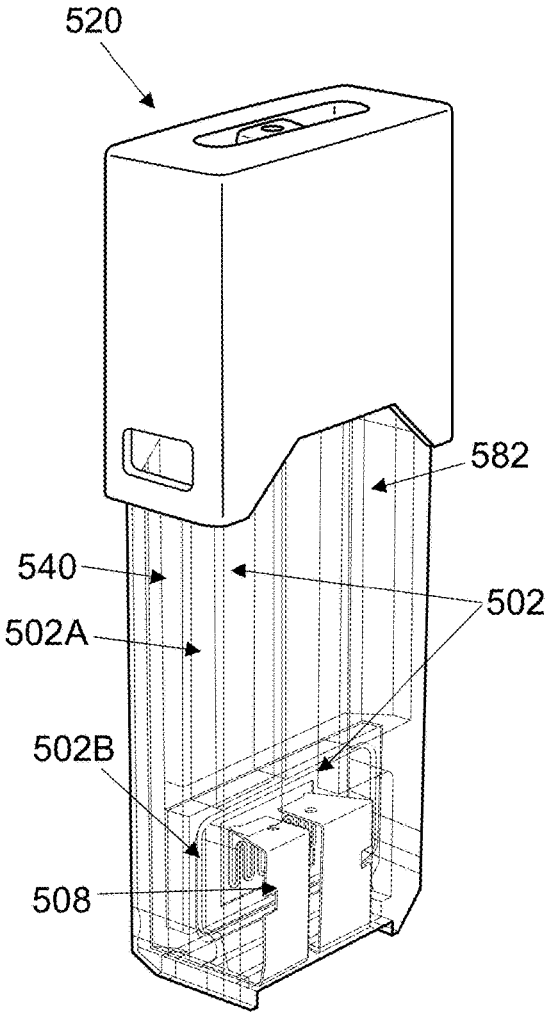
FIG. 17 illustrates an example vaporizer cartridge consistent with implementations of the current subject matter.
Figure 18:
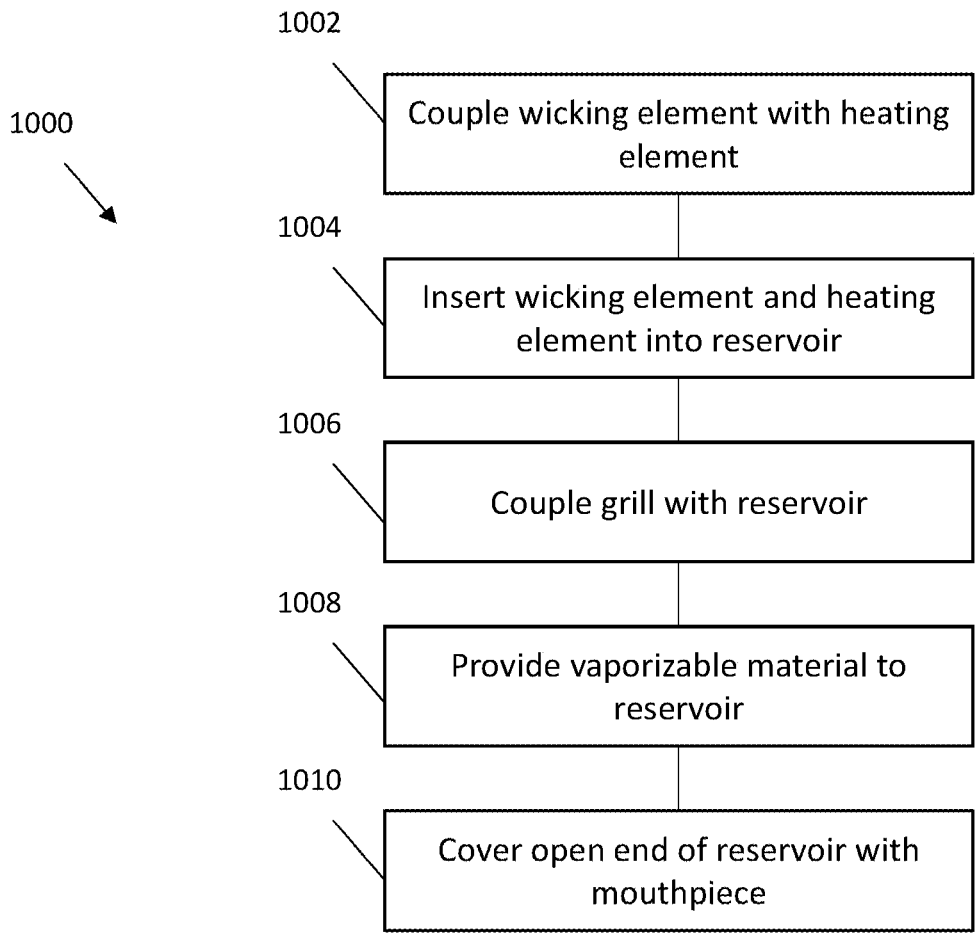
FIG. 18 illustrates an example method of assembling a vaporizer cartridge consistent with implementations of the current subject matter.

FIG. 16 and FIG. 17 illustrate an example vaporizer cartridge 520 consistent with implementations of the current subject matter. The vaporizer cartridge 520 includes the same or similar features as the vaporizer cartridge 120, 320, 420 described herein. For example, the vaporizer cartridge 520 includes a reservoir 540, a heating element 508, and a wicking element 502, which may be the same or similar to the reservoir 140, 340, 440 the heating element 208, 308, 408, and the wicking element 202, 302, 402, respectively. A mouthpiece (not shown) may be coupled to an end of the vaporizer cartridge 520 opposite the heating element 508.

The vaporizer cartridge 520 includes a wicking element 502 in the form of a puck, which may be positioned along a portion of a side, such as a first side 580, of the reservoir 540. As shown in FIG. 16, the puck may be positioned along at least a portion of the first side 480. In some implementations, the wicking element 508 includes a first puck 502A and a fibrous material 502B. The fibrous material 502B may be positioned adjacent the first puck 502A along the first side 480, to enhance the absorption properties of the wicking element 502. The heating element 508 may be positioned along a portion of another side, such as a second side 582, of the reservoir 540, opposite the first side 580. In some implementations, the first puck 502A may be up to approximately 250 mg. This configuration allows for a large amount of the puck (e.g., tobacco) to be visible through the reservoir 540 of the vaporizer cartridge 520, thereby enhancing the user experience.

As shown in FIGS. 16 and 17, the heating element 508 may be pressed against a portion of the wicking element 502 (e.g., the first puck 502A and/or the fibrous material 502B). For example, the heating element 508 may apply a compression force to one side of the wicking element 502, rather than a compression force to two sides of the wicking element and/or a torsion force on the wicking element 502. Applying a compressive force to the wicking element 502, such as to one side of the wicking element 502 may improve the usable life of the wicking element 502 by reducing or eliminating the likelihood that the wicking element 502 will tear or otherwise become damaged when saturated with the fluid vaporizable material. This configuration may also improve the integrity of the wicking element 502.

In this implementation, an increased surface area of the wicking element 502 (e.g., the first puck 502A and/or the fibrous material 502B) is exposed to and is in contact with the vaporizable material. The increased contact between the wicking element 502 (e.g., at least the first puck 502A and/or the fibrous material 502B) and the vaporizable material stored within the reservoir 540 may allow for a greater amount of vaporizable material to be absorbed by or otherwise pass through the wicking element 502. Thus, a greater amount of vaporizable material may be vaporized from the wicking element 502, increasing the efficiency of vaporizing the vaporizable material and increasing the amount of vaporized vaporizable material per puff (e.g., an amount of total particulate matter). As shown in FIGS. 16 and 17, the wicking element 502 may be exposed to the vaporizable material stored within the reservoir 540 along opposing lateral sides of the wicking element 502. Since the wicking element 502 shown in FIGS. 16 and 17 may be formed of a flat pad shape, an increased surface area of the opposing lateral sides of the wicking element 502 may be in fluid communication with the vaporizable material stored within the reservoir 540. The increased exposure by the wicking element 502 to the vaporizable material may provide a larger area for fluid to flow into and re-saturate the wicking element 502 so that the wicking element 502 remains saturated in use. This may be especially useful when the wicking element 502 is composed at least partially of tobacco, to improve the saturation capability of the wicking element 502.

In some implementations, the reservoir 540 of the vaporizer cartridge 520 may have an increased capacity to increase a concentration of tobacco and/or nicotine that is delivered to the user when the user draws on the mouthpiece. The increased concentration of tobacco and/or nicotine may be due at least in part to the increased amount of vaporizable material capable of being stored within the reservoir 540 and/or vaporized by the heating element 508.

In some implementations, the vaporizer device may be configured to accommodate more than one type of vaporizer cartridge (e.g., the vaporizer cartridge 120, 320, 420, 520), such that the vaporizer cartridges are interchangeable with the vaporizer device. For example, the vaporizer device may be capable of accommodating a vaporizer cartridge having a tobacco-based wicking element, such as the vaporizer cartridge 120 discussed above, and another type of cartridge, such as a vaporizer cartridge having a different type of wicking element (e.g., cotton, hemp, silica, ceramic, and/or the like). Each type of vaporizer cartridge may be insertable into the cartridge receptacle 118 of the vaporizer body 110.

In some implementations, the vaporizer body may include one or more (e.g., one, two or more) controllers for controlling delivery of heat to the atomizer to cause the vaporizable material to be converted from a condensed form to the gas phase via either a tobacco-based wicking element or another type of wicking element. In some implementations, a single controller may be configured to control delivery of heat to the atomizer in each respective type of vaporizer cartridge. In such implementations, the controller may control a desired heating temperature of the atomizer in each type of vaporizer cartridge. The desired heating temperature may be the same or may be different depending on the type of vaporizer cartridge inserted into and coupled with the vaporizer device. In other implementations, each controller may be configured to control delivery of heat to the atomizer in each respective type of vaporizer cartridge. For example, each type of vaporizer cartridge may require a same or a different heating temperature profile, flavor profile, target temperature control constants, power limit, and/or the like, depending on the type of wicking element and/or vaporizable material. Thus, it may be desirable for the vaporizer body may first detect the type of vaporizer cartridge that has been inserted into the cartridge receptacle of the vaporizer body. In some implementations, the vaporizer cartridge includes an identification chip, on which the type of vaporizable cartridge (e.g., a vaporizer cartridge having a tobacco-based wicking element or another type of wicking element) may be stored, that is read by a corresponding chip reader on the vaporizer device. When the vaporizer cartridge is inserted into the cartridge receptacle of the vaporizer body, the vaporizer body may detect a particular type of vaporizer cartridge via the chip reader, a controller, or other means.

Once the type of vaporizer cartridge is detected by the vaporizer body (e.g., by a controller), the controller may change the heating temperature profile, flavor profile, target temperature control constants, power limit, and/or the like, of the heat supplied to the heating element of the vaporizer cartridge depending on the type of vaporizer cartridge that is detected. As noted above, a heating element in a tobacco wicking element-based vaporizer cartridge may be heated to a lower temperature to vaporize the vaporizable material absorbed by the tobacco-based wicking element than a heating element in a vaporizer cartridge having a wicking element of a different material. In other embodiments, the heating element in a tobacco wicking element-based vaporizer cartridge may be heated to the same temperature to vaporize the vaporizable material absorbed by the tobacco-based wicking element as a heating element in a vaporizer cartridge having a wicking element of a different material.

Additionally and/or alternatively, the controller may adjust the heating temperature profile, flavor profile, target temperature control constants, power limit, and/or the like, of the heat supplied to the heating element of the vaporizer cartridge upon receipt of one or more user inputs via the vaporizer device. For example, the controller may receive, via the vaporizer device, one or more user inputs, such as a button or other portion of the vaporizer device being pressed by the user. Additionally and/or alternatively, the controller may receive one or more gesture-based user inputs to adjust the heating temperature profile, and the like. For example, the gesture-based user inputs may include tapping and/or shaking the vaporizer device, such as in a predetermined pattern.

Additionally and/or alternatively, each type of vaporizer cartridge may include a different type of heating element (e.g., heating elements having different resistance properties). For example, a first type of vaporizer cartridge, such as a vaporizer cartridge including a tobacco wick-based wicking element, may include a heating element that has a resistance of approximately 1 Ohm. In other implementations, the vaporizer cartridge having the tobacco wick-based wicking element may include a heating element that has a resistance of approximately 0.5 to 1 Ohm, 1 Ohm to 1.5 Ohms, 1.5 Ohms to 2.0 Ohms, or other ranges therebetween. In some implementations, a second type of vaporizer cartridge, such as a vaporizer cartridge including another type of wicking element (e.g., cotton, silica, and the like), may include a heating element that has a resistance of approximately 2 Ohms. In other implementations, the vaporizer cartridge having the tobacco wick-based wicking element may include a heating element that has a resistance of approximately 1.0 to 1.5 Ohms, 1.5 Ohms to 2.0 Ohms, 2.0 Ohms to 2.5 Ohms, 2.5 Ohms to 3.0 Ohms, or other ranges therebetween. In other words, the heating element in a vaporizer cartridge having a wicking element that includes tobacco may have a lower resistance than the heating element in the vaporizer cartridge having a wicking element that does not include tobacco (e.g., a wicking element that includes cotton, silica, and the like). This helps to account for the different vaporization temperatures of vaporizable material held in a tobacco-based wicking element compared to other types of wicking elements.

Referring to FIGS. 5 and 23-25, the wicking element 202 is configured for use in vaporizer devices, such as the vaporizer device 100 shown in FIG. 1A. The wicking element 202 can be composed, at least partially, of tobacco. Tobacco provides a natural source of nicotine and tobacco flavoring. Thus, a wicking element composed at least partially of tobacco may provide an enhanced user experience for the user when operating the vaporizer device 100.

However, in some implementations, the tobacco may not be highly absorbent when interacting with vaporizable material, such as the vaporizable material contained in a reservoir 140 of the vaporizer device 100. Though in some implementations the wicking element 202 can be made entirely of tobacco, in other implementations, the wicking element 202 can be made of a composite blend including one or more types of tobacco blended with one or more other materials. The one or more other materials may aid in improving absorption of the vaporizable material by the wicking element 202. For example, the composite blend may include tobacco and one or more other rigid, compressible, and/or fibrous materials, such as cotton, hemp, silica, ceramic, and/or the like. In particular, relative to some other materials, a composite blend including tobacco and cotton may allow for an increased and/or more controllable flow rate of vaporizable material from the reservoir 140 into the wicking element 202 to be vaporized.

In some implementations, the composite blend of the wicking element 202 may include one or more types of tobacco, one or more binders, one or more humectants, and one or more fibrous materials. The respective proportions of tobacco, binder, humectant, and fibrous material can vary according to the desired material properties and/or manufacturability of the wicking element 202. For example, as the proportion of tobacco in the wicking element 202 increases, a greater amount of nicotine may be drawn from the wicking element and inhaled by the user as part of the vaporized vaporizable material. In some implementations, as the proportion of the fibrous material in the wicking element 202 increases and/or the porosity of the tobacco increases, a greater amount of vaporizable material may be absorbed by the wicking element 202 before, during, or after a user's puff.

For example, if greater amount of nicotine and/or tobacco flavoring is desired, the wicking element can include a higher proportion of tobacco than fibrous material (e.g., a ratio of an amount of tobacco to fibrous material of 7 to 3, 8 to 2, and the like). If a greater amount of absorbability is desired, the wicking element can include a higher proportion of fibrous material (e.g., a ratio of an amount of tobacco to fibrous material of 6 to 4, 5 to 5, 4 to 6, and the like). The wicking element blend described herein can include any proportions of tobacco and fibrous material, in accordance with the desired properties of the wicking element, and the specific proportions described above are non-limiting and provided merely for demonstration purposes.

One or more types of tobacco, such as reconstitute tobacco (e.g., cast and/or sheet), expanded tobacco, such as tobacco (e.g., stems of tobacco leaves) that may be expanded using a steam process, dry-ice expanded tobacco (DIET), flue-cured tobacco, air-cured tobacco (e.g., burley), and various types of loose-leaf materials and blends, among other tobacco plant materials, may be blended. The one or more binders, which help to bind the tobacco grains and/or adhere the tobacco with the one or more fibrous materials, may include carboxymethyl cellulose (CMC) (e.g., cellulose gum), guar gum, xanthum gum, tamarind gum, methyl cellulose, and/or the like. The one or more humectants, which help to retain moisture and reduce moisture loss in the wicking element 202, may include propylene glycol (PG), vegetable glycerin (VG), a mixture of PG and VG (PG/VG), and/or the like. As noted above, the one or more fibrous materials may include cotton (e.g., cotton fibers), hemp (e.g., hemp fibers), silica, ceramic, Ahlstrom 350 grade, and/or the like.

Figure 5:
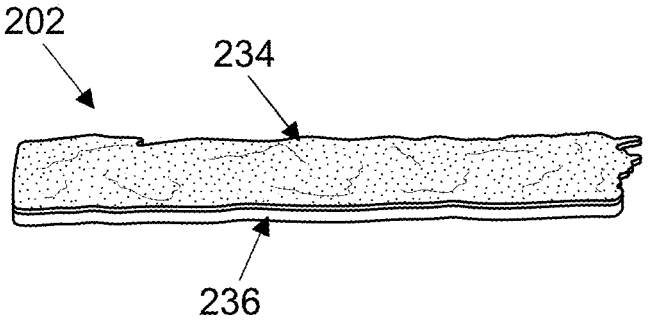
FIG. 5 illustrates an example wicking element for a vaporizer cartridge consistent with implementations of the current subject matter.
Figure 6:
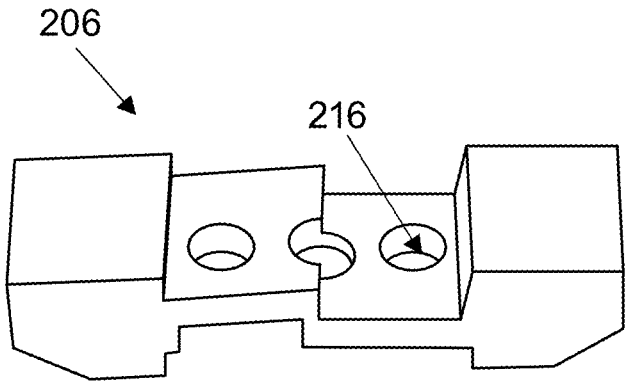
FIG. 6 illustrates an example of a grill for a vaporizer cartridge consistent with implementations of the current subject matter.

As shown in FIG. 5, the wicking element 202 may form an extruded sheet. The wicking element 202 may also take the form of other various shapes and sizes as noted above, and may be configured to contact a heating element of an atomizer of the vaporizer device 100 (such as the vaporizer cartridge 120) and/or be secured between at least two portions of the heating element.

Figure 19:
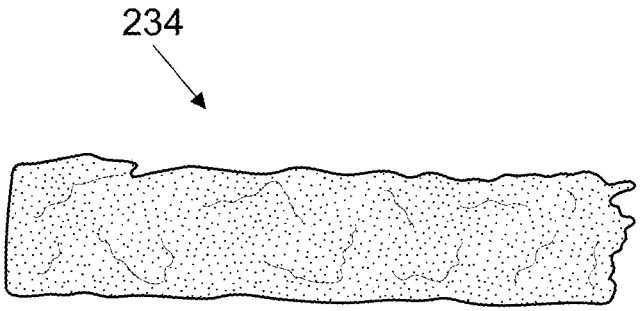
FIG. 19 illustrates a tobacco puck for the wicking element of FIG. 5, consistent with implementations of the current subject matter.

The wicking element 202 can be manufactured in various manners. First a tobacco puck 234 (e.g., a wicking element entirely made of tobacco, or without a fibrous material) can be formed. An example of the tobacco puck 234 is illustrated in FIG. 19.

Figure 20:
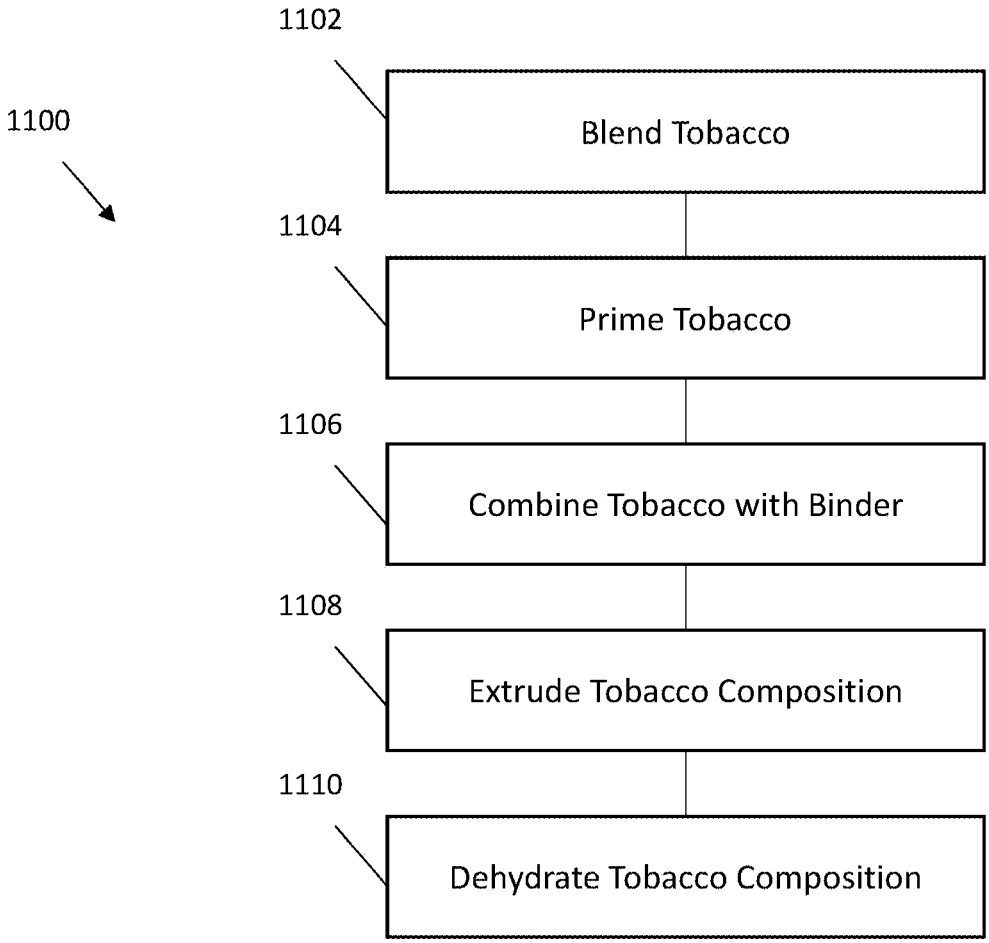
FIG. 20 illustrates an example method of forming the tobacco puck of FIG. 5, consistent with implementations of the current subject matter.

FIG. 20 illustrates an example method 1100 of forming the tobacco puck 234 consistent with implementations of the current subject matter.

At 1102, one or more types of tobacco and/or grain sizes of tobacco, may be blended as noted above. For example, one or more of reconstitute tobacco (e.g., cast and/or sheet), dry-ice expanded tobacco (DIET), flue-cured tobacco, air-cured tobacco (e.g., burley), and various types of loose-leaf materials and blends, may be blended. In some implementations, each type of tobacco may have a grain size of approximately 125 to 250 microns. In one example, a tobacco blend may include 60% of a first type of tobacco (e.g., flue-cured tobacco having a grain size of 125 to 250 microns) and 40% of a second type of tobacco (e.g., burley tobacco having a grain size of 125 to 250 microns). In another example, the tobacco blend may include 100% of the first type of tobacco or 100% of the second type of tobacco. The respective proportions of each type of tobacco blended can vary according to the desired material properties and/or manufacturability of the wicking element 202.

At 1104, the tobacco blend may be primed. For example, the tobacco blend may be mixed with a PG/VG mixture. The PG/VG mixture may include various ratios of PG and VG according to the desired material properties of the wicking element 202. The PG/VG mixture may include nicotine to increase the concentration of nicotine that is vaporized as part of the vaporized vaporizable material during a user puff.

At 1106, the tobacco may be mixed with a binder. As noted above, the binder may help to bind the grains of tobacco. The binder may include a mixture of one or more of carboxymethyl cellulose (CMC) (e.g., cellulose gum), guar gum, xanthum gum, tamarind gum, methyl cellulose, and/or the like. In some implementations, the binder includes a methylcellulose foam, which may result in less shrinkage of the tobacco puck 234 when the tobacco composition is dehydrated. The methylcellulose foam may include one or more of methylcellulose and xanthum gum, among other materials. In some implementations, the methylcellulose foam includes 3.5 g of methylcellulose and 0.9 g of xantham gum. The methylcellulose foam may include various ratios of methylcellulose to xantham gum according to the desired material properties of the wicking element 202.

In some implementations, it may be desirable to increase porosity of the tobacco composition to improve the absorbability of the tobacco puck. To increase porosity, other materials, such as sodium sulphate decahydrate may be mixed with the binder and tobacco blend. To increase porosity, the salt crystals of the sodium sulphate decahydrate may become mixed with the tobacco blend and thereby leave voids when melted when the tobacco composition is dehydrated.

At 1108, the tobacco composition may be extruded to form the tobacco puck 234. The tobacco composition may be extruded by various manufacturing means.

At 1110, the tobacco puck 234 may be dehydrated. For example, the tobacco puck 234 may be air-dried, or a heating source can be applied to the tobacco puck 234, such as an oven.

After manufacturing the tobacco puck 234 in any of the aforementioned manners, the structure can be processed so as to form individual tobacco pucks 204 for further processing to form the wicking element 202. The processing of the tobacco puck structure can include various operations known in the art such as, for example, cutting the structure into appropriately sized pieces, and the like. The tobacco puck structure may also be cut to remove irregularities (e.g., air gaps, bends, twists, and the like).

Figure 21:
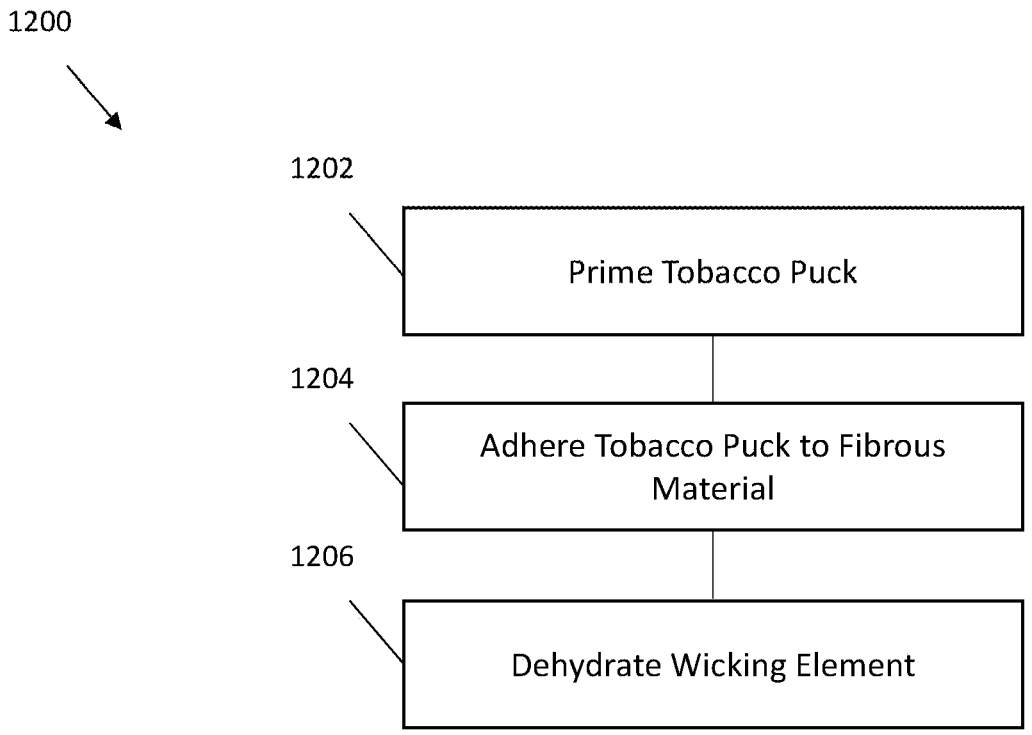
FIG. 21 illustrates an example method of forming the wicking element of FIG. 5, consistent with implementations of the current subject matter.
Figure 22:
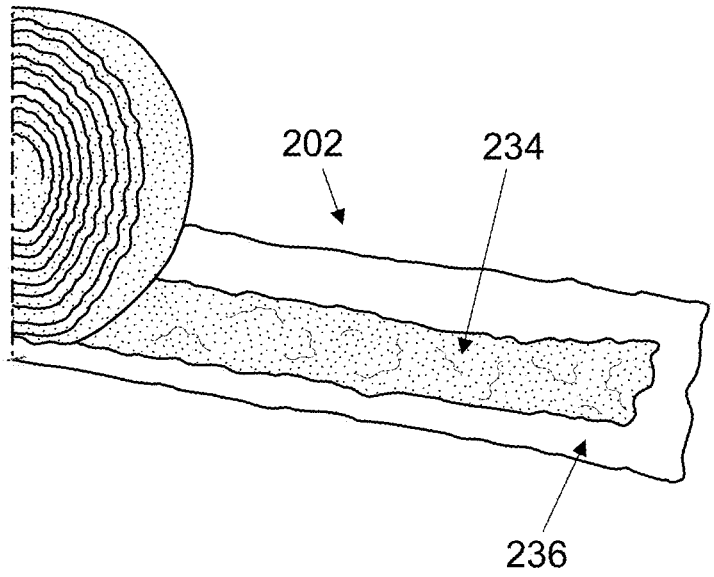
FIG. 22 illustrates an example of a tobacco puck and a fibrous material, consistent with implementations of the current subject matter.

After the tobacco puck 234 is formed, the tobacco puck 234 may be combined with one or more other materials, such as at least one of the fibrous materials, to form the wicking element 202. FIG. 21 illustrates an example method 1200 of forming the wicking element 202 consistent with implementations of the current subject matter.

At 1202, the tobacco puck 234 may be primed using a binder, as described herein. For example, a binder may be applied to the tobacco puck. As noted above, the binder helps to adhere the tobacco puck 234 to the fibrous material.

At 1204, the primed tobacco puck 234 may be adhered, or otherwise coupled, to a fibrous material 236 to form the wicking element 202. For example, the tobacco puck 234 may be pressed onto a fibrous sheet.

At 1206, the wicking element 202 may be dehydrated. For example, the wicking element 202 may be air-dried, or a heating source can be applied to the wicking element 202, such as a dehydrator or an oven.

After manufacturing the wicking element 202 in any of the aforementioned manners, the structure can be processed so as to form individual wicking elements for insertion into the vaporizer device 100 (e.g., the vaporizer cartridge 120). The processing of the wicking element structure can include various operations known in the art such as, for example, cutting the structure into appropriately sized pieces, and the like. The wicking element structure may also be cut to remove irregularities (e.g., air gaps, bends, twists, and the like).

As noted above, the wicking element 202 can convey an amount of a vaporizable material to the atomizer 141 through capillary pressure which causes fluid motion. By incorporating tobacco into the wicking element 202, nicotine from the wicking element 202 may be drawn into the vaporizable material, such as upon vaporization of the vaporizable material. In some implementations, the nicotine content of the vaporized vaporizable material may be adjusted by additionally adding nicotine to the vaporizable material. In some implementations in which the fibrous material is combined with the tobacco, the wicking element may draw greater amounts of vaporizable material from the reservoir 140, and thus greater amounts of the liquid vaporizable material can be vaporized due at least in part to the enhanced capillary strength of the fibrous material. In other words, the capillary action of the tobacco-fibrous material composite-based wicking element described herein can release and replenish greater amounts of liquid vaporizable material for vaporization by the heating element (described below), thereby enhancing a user's overall experience when operating the vaporizer device 100. The tobacco-fibrous material composite-based wicking element may also enhance the user's experience when operating the vaporizer device 100 by providing a more natural flavor profile, a more natural source of nicotine, and/or a natural appearance of tobacco or tobacco product.

Figure 23:
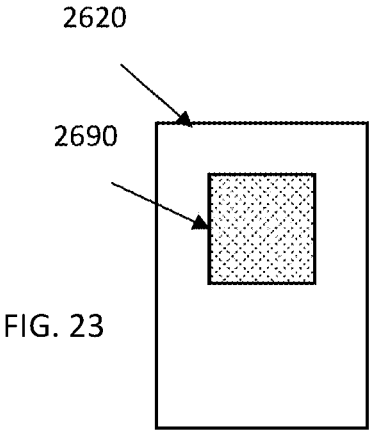
FIGS. 23-28 illustrate example vaporizer cartridges, consistent with implementations of the current subject matter.

FIGS. 23-28 illustrate other examples of a vaporizer cartridge, which may include the wicking element described herein. For example, FIG. 23 illustrates an example of a vaporizer cartridge 2620 in which tobacco (e.g., the wicking element 202, or loose-leaf tobacco particles) may be exposed through a window 2690 in the vaporizer cartridge 2620.

Figure 24:
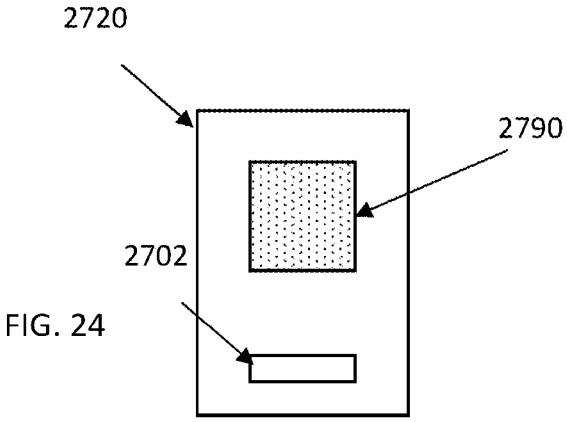

FIG. 24 illustrates an example of a vaporizer cartridge 2720 in which tobacco may be exposed through a window 2790 in the vaporizer cartridge 2720. The tobacco may be exposed through the window 2790 by peeling back a layer on the vaporizer cartridge 2720. The exposed tobacco may produce a tobacco aroma that may enhance the user experience.

Figure 25:
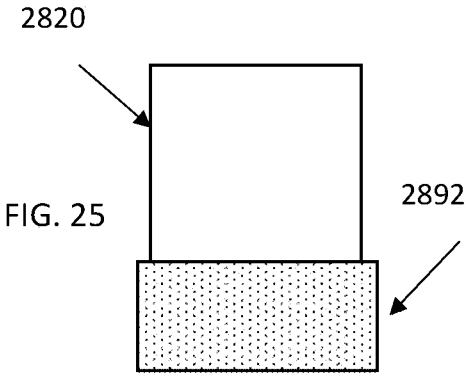

FIG. 25 illustrates an example of a vaporizer cartridge 2820 in which a least a portion of the vaporizer cartridge is wrapped with a tobacco material 2892 (e.g., reconstituted tobacco). The wrapped tobacco produces a tobacco aroma that may enhance the user experience.

Figure 26:
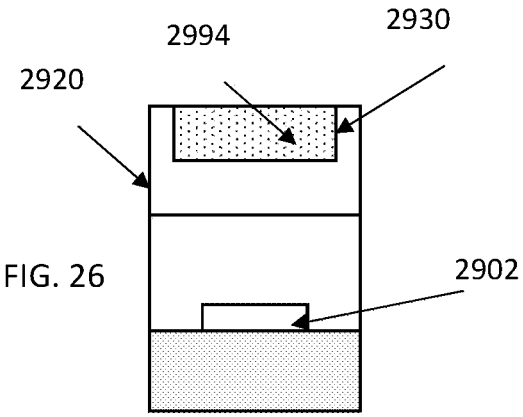

FIG. 26 illustrates an example of a vaporizer cartridge 2920 in which a tobacco material 2994 is positioned adjacent and/or within a mouthpiece 2930 of the vaporizer cartridge 2920. The vaporizable material would be vaporized from the wicking element 2902 and pass through the tobacco material 2994 before exiting the mouthpiece 2930. The vaporized vaporizable material may absorb a tobacco aroma as the material passes through the tobacco material 2994 that may enhance the user experience.

Figure 27:
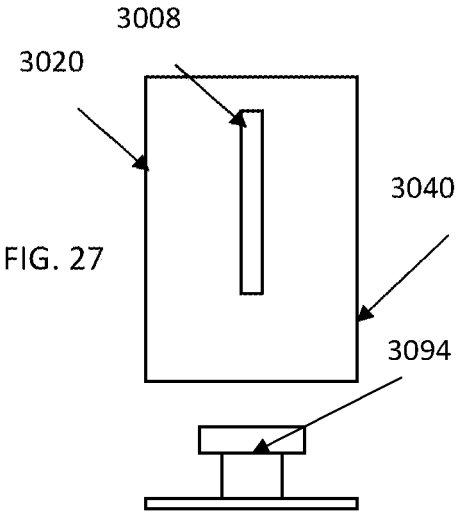

FIG. 27 illustrates an example of a vaporizer cartridge 3020 in which a tobacco material 3094 is insertable into a reservoir 3040 of the vaporizer cartridge 3020. Once the tobacco material 3094 is inserted into the reservoir 3040, the tobacco material 3094 may contact a heating element 3008 of the vaporizer cartridge to be vaporized.

Figure 28:
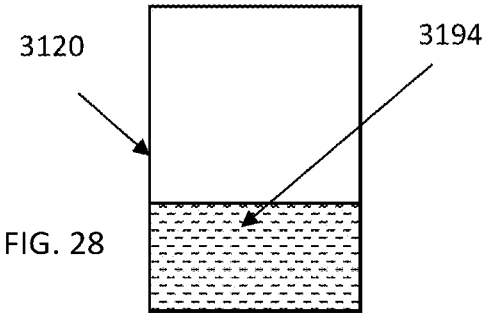

FIG. 28 illustrates an example of a vaporizer cartridge 3120 in which a tobacco material 3194 is suspended in a vaporizable material. This configuration may give the appearance of a tobacco flavor and/or aroma produced by the vaporizer cartridge 3120, which may enhance the user experience.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A vaporizer cartridge for a vaporizer device, the vaporizer cartridge comprising:

a vaporizer cartridge body comprising a first end and a second end opposite the first end, the vaporizer cartridge body comprises, a reservoir configured to hold a vaporizable material, a wicking element configured to draw the vaporizable material from the reservoir, the wicking element comprising tobacco, a heating element coupled with the wicking element, the heating element configured to heat the wicking element to cause the vaporizable material to vaporize, and a grill coupled to and positioned at the second end of the vaporizer cartridge body, thereby securing the wicking element and the heating element within the vaporizer cartridge body; and a mouthpiece coupled to the first end of the vaporizer cartridge body.

2. The vaporizer cartridge of claim 1, wherein the heating element is crimped about the wicking element.

3. The vaporizer cartridge of claim 1, wherein the heating element is preformed to receive the wicking element.

4. The vaporizer cartridge of claim 1, wherein the heating element contacts at least one side of the wicking element.

5. The vaporizer cartridge of claim 1, wherein the heating element is pressed against one side of the wicking element.

6. The vaporizer cartridge of claim 1, wherein the wicking element is positioned between two portions of the heating element.

7. The vaporizer cartridge of claim 1, wherein the wicking element extends from a proximal end to a distal end of the reservoir.

8. The vaporizer cartridge of claim 7, wherein the wicking element further comprises a fibrous material and a puck comprising the tobacco, the fibrous material being positioned adjacent to the puck.

9. The vaporizer cartridge of claim 1, wherein the grill comprises one or more perforations to control the flow of air through the vaporizer cartridge.

10. The vaporizer cartridge of claim 1, wherein the wicking element further comprises a fibrous material coupled to the tobacco.

11. The vaporizer cartridge of claim 1, wherein at least a portion of the grill is in direct contact with the wicking element.

12. The vaporizer cartridge of claim 1, further comprising a wick housing surrounding at least a portion of the heating element and the wicking element.

13. The vaporizer cartridge of claim 1, wherein the grill comprises a first end, a second end, and a base structure extending therebetween, wherein the grill comprises one or more perforations in only the base structure.

14. The vaporizer cartridge of claim 1, wherein the vaporizer cartridge comprises a first end and a second end, and wherein the grill and the second of the vaporizer cartridge body, in combination, form the second end of the vaporizer cartridge.

15. The vaporizer cartridge of claim 1, wherein the grill is positioned upstream of the heating element and the wicking element.

16. A vaporizer cartridge for a vaporizer device, the vaporizer cartridge comprising:

a vaporizer cartridge body comprising a first end and a second end opposite the first end, the vaporizer cartridge body comprises, a reservoir configured to hold a vaporizable material, a wicking element configured to draw the vaporizable material from the reservoir, the wicking element comprising tobacco, a heating element coupled with the wicking element, the heating element configured to heat the wicking element to cause the vaporizable material to vaporize, and one or more cartridge contacts;

a grill coupled to and positioned at the second end of the vaporizer cartridge body, thereby securing the wicking element and the heating element within the vaporizer cartridge body, wherein the grill includes one or more openings through which at least a portion of the one or more cartridge contacts passes therethrough; and a mouthpiece coupled to the first end of the vaporizer cartridge body.

* * * * *